US008251298B2

(12) United States Patent
Tatehira et al.

(10) Patent No.: US 8,251,298 B2
(45) Date of Patent: Aug. 28, 2012

(54) INSTALLATION CONSTRUCTION METHOD FOR BOILER FACILITIES

(75) Inventors: Kazuki Tatehira, Kure (JP); Yukitaka Machida, Kure (JP); Tadayoshi Mariyama, Kure (JP)

(73) Assignee: Babcock-Hitachi Kabushiki Kaisha, Tokyo (JP)

( * ) Notice: Subject to any disclaimer, the term of this patent is extended or adjusted under 35 U.S.C. 154(b) by 1411 days.

(21) Appl. No.: 11/522,922

(22) Filed: Sep. 19, 2006

(65) Prior Publication Data

US 2007/0089296 A1 Apr. 26, 2007

(30) Foreign Application Priority Data

Oct. 12, 2005 (JP) ..... 2005-297878

(51) Int. Cl.
*F24H 3/06* (2006.01)

(52) U.S. Cl. ..... 237/16; 237/58; 122/459; 122/460; 122/493; 122/494; 29/890; 29/469; 29/890.051; 29/890.031; 29/890.03

(58) Field of Classification Search ..... 237/16, 237/58; 29/890, 469, 890.051, 890.031, 29/890.03; 122/459, 460, 493, 494
See application file for complete search history.

(56) References Cited

U.S. PATENT DOCUMENTS

| | | | | |
|---|---|---|---|---|
| 4,231,148 | A * | 11/1980 | Harding | 29/469 |
| 5,168,674 | A * | 12/1992 | Molthen | 52/2.16 |
| 5,577,362 | A * | 11/1996 | Yamashita et al. | 52/745.03 |
| 6,588,104 | B2 * | 7/2003 | Heidrich | 29/890.051 |
| 7,296,349 | B2 * | 11/2007 | Gartner et al. | 29/890.051 |
| 2001/0023665 | A1 * | 9/2001 | Heidrich | 122/510 |
| 2005/0072000 | A1 * | 4/2005 | Gartner et al. | 29/890.051 |

FOREIGN PATENT DOCUMENTS

| | | | |
|---|---|---|---|
| JP | 7-91603 | A | 4/1995 |
| JP | 8-114302 | A | 5/1996 |
| JP | 8-261405 | A | 11/1996 |
| JP | 11-211003 | A | 8/1999 |
| JP | 2002-98304 | A | 4/2002 |
| JP | 2002-213707 | A | 7/2002 |

* cited by examiner

*Primary Examiner* — Steven B McAllister
*Assistant Examiner* — Avinash Savani
(74) *Attorney, Agent, or Firm* — Crowell & Moring LLP

(57) ABSTRACT

With an installation construction method for boiler facilities, the boiler facilities comprise a boiler building configured of a steel structure, and a boiler main unit suspended within the boiler building from the upper portion of the boiler building. A portion of the boiler building is constructed, a portion of the boiler main unit is suspended from the upper portion of the partially-constructed boiler building, and while the remaining steel structure portions are being added to the partially-constructed boiler building so as to construct the boiler building, the remaining portions of the boiler main unit are added to complete the boiler main unit.

6 Claims, 32 Drawing Sheets

INSTALLATION CONSTRUCTION METHOD FOR BOILER FACILITIES

BACKGROUND OF THE INVENTION

1. Field of the Invention

The present invention relates an installation construction method for boiler facilities, and particularly relates to an installation construction method wherein the installation construction schedule can be markedly reduced.

2. Description of the Related Art

FIG. 11 is a schematic configuration diagram of a common boiler facility for electric power production. A boiler main unit 1 is disposed within a boiler building 3 configured of a steel structure 2 around and above, and is suspended from top girders 4 traversing the top of the boiler building 3 by sling bolts.

Secondary air for combustion to the boiler main unit 1 is guided to a furnace combustion chamber with a burner, via a forced draft fan, an air pre-heater 5, a wind box 6, and so on forth. Also, coal fuel transporting air is guided from the air pre-heater 5 to a mill 8 via a primary air duct 7.

Coal to serve as fuel is stored in a bunker 9, and is supplied to the mill 8 while being measured by a stoker 10, and is pulverized to a predetermined particle size. The fine powder coal generated at the mill 8 is supplied to the burner disposed within the wind box 6 through a fuel pipe along with the coal fuel transporting air, and is burned in the furnace combustion chamber.

The hot combustion gas generated by combustion in the furnace combustion chamber is then subjected to heat exchanges within an internal fluid flowing through a secondary superheater 11, a tertiary superheater 12, a reheater 13, a primary superheater 14, an economizer 15, and so on forth, disposed within an air flue of the boiler main unit 1. The combustion gas subjected to heat exchange passes through an economizer discharge gas duct 16, a denitration device, the air pre-heater 5, and an air pre-heater discharge gas duct 17, and is externally discharged from the boiler building 3.

On the other hand, water feed to the boiler main unit 1 is performed by water passing from a condenser outside of the boiler building 3 through a main water pipe to each of the heat exchangers such as the economizer 15, where heat exchange creates high-temperature high-pressure steam, which passes through a main steam pipe and is guided to a high-pressure turbine outside of the boiler building 3.

Steam from a medium-pressure turbine is guided to the reheater 13 via a low-temperature reheating steam pipe, and the reheated steam passes through a high-temperature reheating steam pipe and is guided to a low-pressure turbine outside of the boiler building 3.

FIGS. 12 through 21 are schematic configuration diagrams for describing a conventional boiler facilities installation construction method. In these drawings, FIGS. 13, 15, 17, 19, and 21, are views taken along line A-A in FIGS. 12, 14, 16, 18, and 20, respectively.

As shown in FIGS. 12 and 13, first, a predetermined number of first-level steel columns 21 are erected, and between the first-level steel columns 21 are assembled first floor beams for a floor 22 and second floor beams for a floor 23. Next, as shown in FIGS. 14 and 15, second-level steel columns 24 are erected upon the first-level steel columns 21, and between the second-level steel columns 24 are assembled third floor beams for a floor 25 and fourth floor beams for a floor 26. Next, as shown in FIGS. 16 and 17, third-level steel columns 27 are erected upon the second-level steel columns 24, and between the third-level steel columns 27 are assembled fifth floor beams for a floor 28 and sixth floor beams for a floor 29. Next, as shown in FIGS. 18 and 19, fourth-level steel columns 30 are erected upon the third-level steel columns 27, and between the fourth-level steel columns 30 are assembled seventh floor beams for a floor 31, eighth floor beams for a floor 32, and top girders 33, thereby completing construction of the boiler building 34.

Subsequently, as shown in FIGS. 20 and 21, the top girders 33 are used to suspend the boiler main unit 35 from the top of the boiler building 34. Also, ducts 36, a bunker 37, stoker 38, fuel pipes 39, soot blower 40, various types of piping, cable tray 41, railing, electric panel, and so on forth, are carried into the boiler building 34 from the sides, by crane, temporary monorail, chain hoist, and so on forth, and positioned and welded into place, thereby completing installation of the boiler facilities.

Thus, with the conventional boiler facility installation construction method, the series of work from manufacturing the steel beams to installation on-site to construct the boiler building has been performed by a steel fabrication manufacturer. The ducts, bunker, stoker, fuel pipes, soot blower, various types of piping, cable tray, railing, electric panel, and so on forth, to be installed in the boiler building have been carried in and installed following completion of the boiler building.

This means that the work of carrying in and installing various types of equipment and accessories is concentrated in the period following completion of the boiler building, leading to problems in that all work regarding ducts, piping, and so on forth, is high-place work, meaning deterioration in work capability, and in that work within a limited space means work is restricted, requiring a longer construction schedule, and further that the amount of high-risk work at high places is great, leading to higher construction costs, and increased risk of workplace accidents.

Also, with arrangements wherein multiple members are combined to form a unit, and these are hoisted above the installation location using a crane and the lower for installation, already-assembled beams, columns, various types of equipment, accessory members, and the like, tend to interfere with carrying in and installing the units.

In order to solve the above problems, the present Inventors have previously studied a boiler facility installation method such as illustrated in FIGS. 22 through 31. In these drawings, FIGS. 23, 25, 27, 29, and 31, are views taken along line A-A in FIGS. 22, 24, 26, 28, and 30, respectively.

First, as shown in FIGS. 22 and 23, a predetermined number of first-level steel columns 21 are assembled, and in conjunction therewith, a first floor unit 45 is disposed between the first-level steel columns 21. A floor unit has at least floor beams and a floor, and has been assembled beforehand, taking the hoisting limit load of the crane into consideration.

A duct block 47, fuel pipe block 48, cable tray 49, mill, and so on forth, are carried in above the first floor unit 45, and installed. A second floor unit 50 is assembled above the first floor unit 45, with a duct block 47 and stoker 51 being carried in and attached.

Next, as shown in FIGS. 24 and 25, second-level steel columns 24 are erected, with a third floor unit 52 and fourth floor unit 53 being disposed between the second-level steel columns 24, and also a bunker cone block 57, piping 55, soot blower 56, and so on forth, being carried in and installed.

Next, as shown in FIGS. 26 and 27, third-level steel columns 27 are erected, with a fifth floor unit 58 being disposed between the third-level steel columns 27, and also piping 55, soot blower 56, and so on forth, being carried in and installed.

A sixth floor unit 59 is assembled above the fifth floor unit 58, with a piping skid and bunker cylinder block 60 and the like being carried in and installed. The piping skid is configured of integrally linking at least piping and valves.

Next, as shown in FIGS. 28 and 29, fourth-level steel columns 30 are erected, and following piping 55 and the like being carried in and installed, a seventh floor unit 61 and eighth floor unit 62 are disposed between the fourth-level steel columns 30, and also top girders 33 and the like are carried in and installed.

As shown in FIGS. 30 and 31, the boiler main unit 35 is carried in from a rear opening portion 64 of the boiler building 34, the boiler main unit 35 is lifted up to a predetermined height using crane, winches or jacks, and is suspended from the top girders 33 by sling bolts. Other equipment and accessories and the like which could not be carried in parallel to construction of the boiler building 34 can be carried in and installed following completion of the construction of the boiler building 34.

According to this installation method, a great part of the various types of equipment and accessory members to be installed within the boiler building can be assembled near the ground rather than at high places, and can be directly assembled by crane as with the steel structure, so work safety can be improved, and construction costs can be reduced due to standardization of work amount during the construction schedule and improved work efficiency.

Boiler facility installation construction methods are described in, for example, Japanese Unexamined Patent Application Publication No. 07-091603, Japanese Unexamined Patent Application Publication No. 08-114302, Japanese Unexamined Patent Application Publication No. 08-261405, Japanese Unexamined Patent Application Publication No. 11-211003, Japanese Unexamined Patent Application Publication No. 2002-098304, and Japanese Unexamined Patent Application Publication No. 2002-213707.

However, the boiler facility installation construction method illustrated in FIGS. 22 through 31 is not trouble-free, either. FIG. 32 is a schematic plan view illustrating each of the zones of the boiler facilities. As shown in the drawing, the boiler facilities can be generally divided into a first zone 65 extending from the front of the boiler facilities to either side thereof, a second zone 66 which is the back side of the boiler facilities, and a third zone 67 which is the inner side surrounded by the first zone 65 and the second zone 66.

With the above-described earlier-studied boiler facility installation construction method, beams for suspending the boiler main unit are installed at the top of the boiler building following completion of the first zone 65, the boiler main unit is carried into the third zone 67 from the second zone 66, where it is suspended from the beams, and subsequently thermal insulation and the like is installed where necessary.

Accordingly, the construction schedule for the boiler facilities can be generally classified into a steel structure construction/facilities installation period, a boiler main unit installation period, and a thermal insulation installation period, with a certain construction period allocated for each. As one example, for a commercial-use 700 megawatt class coal fuel boiler facility, there has been the need to allow 7 months, 9 months, and 8 months, respectively, for these three periods, meaning that a total of 24 months is required.

However, as of recent, there is great demand for reduction in the construction schedule from the perspective of cash flow and from the perspective of early electric power selling from starting operations early, and this demand cannot be met. A particularly troublesome factor is how large the units can be manufactured and transported to the site. For example, in the event that the location for installation is extremely easily accessible, such as on the waterfront accessible by large work barges, giant-sized units could be floated in and installed. However, this is not always the case, and road width may mandate the size of the units. Not being able to transport giant-sized units to the site is a particular problem.

SUMMARY OF THE INVENTION

The present invention has been made to solve the aforementioned problems, and accordingly, it is an object of the present invention thereof to provide an installation construction method for boiler facilities wherein the installation construction schedule can be markedly reduced.

According to an aspect of the present invention, with an installation construction method for boiler facilities in which the boiler facilities include a boiler building configured of a steel structure, and a boiler main unit suspended within the boiler building from the upper portion of the boiler building, a portion of the boiler building is constructed, a portion of the boiler main unit is suspended from the upper portion of the partially-constructed boiler building, and while the remaining steel structure portions are being added to the partially-constructed boiler building so as to construct the boiler building, the remaining portions of the boiler main unit are added to complete the boiler main unit.

While adding the remaining steel structure portion of the boiler building, various types of equipment to be provided to the boiler main unit and accessory members accessory thereto may be carried into the boiler building under construction, and installed.

As described above, construction of the boiler building and completion of the boiler main unit are performed in parallel, so the installation construction schedule can be markedly reduced.

DESCRIPTION OF THE PREFERRED EMBODIMENTS

Next, an embodiment of the present invention will be described, with reference to the drawings. FIGS. 1 through 10 are schematic configuration diagrams for describing the boiler facilities installation construction method according to the present embodiment. In these drawings, FIGS. 2, 4, 6, 8, and 10, are views taken along line A-A in FIGS. 1, 3, 5, 7, and 9, respectively.

Figure 1:
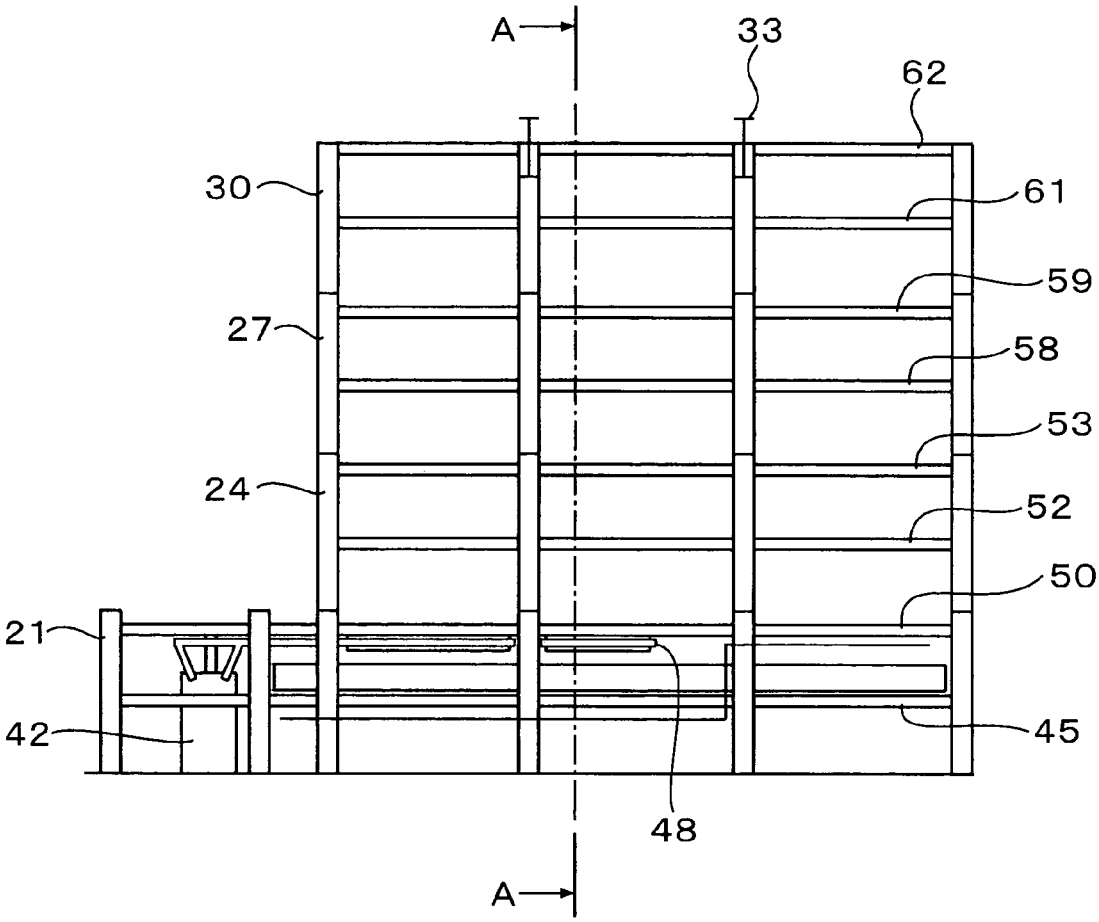
FIG. 1 is a schematic configuration diagram for describing the boiler facilities installation construction method according to an embodiment of the invention.
Figure 2:
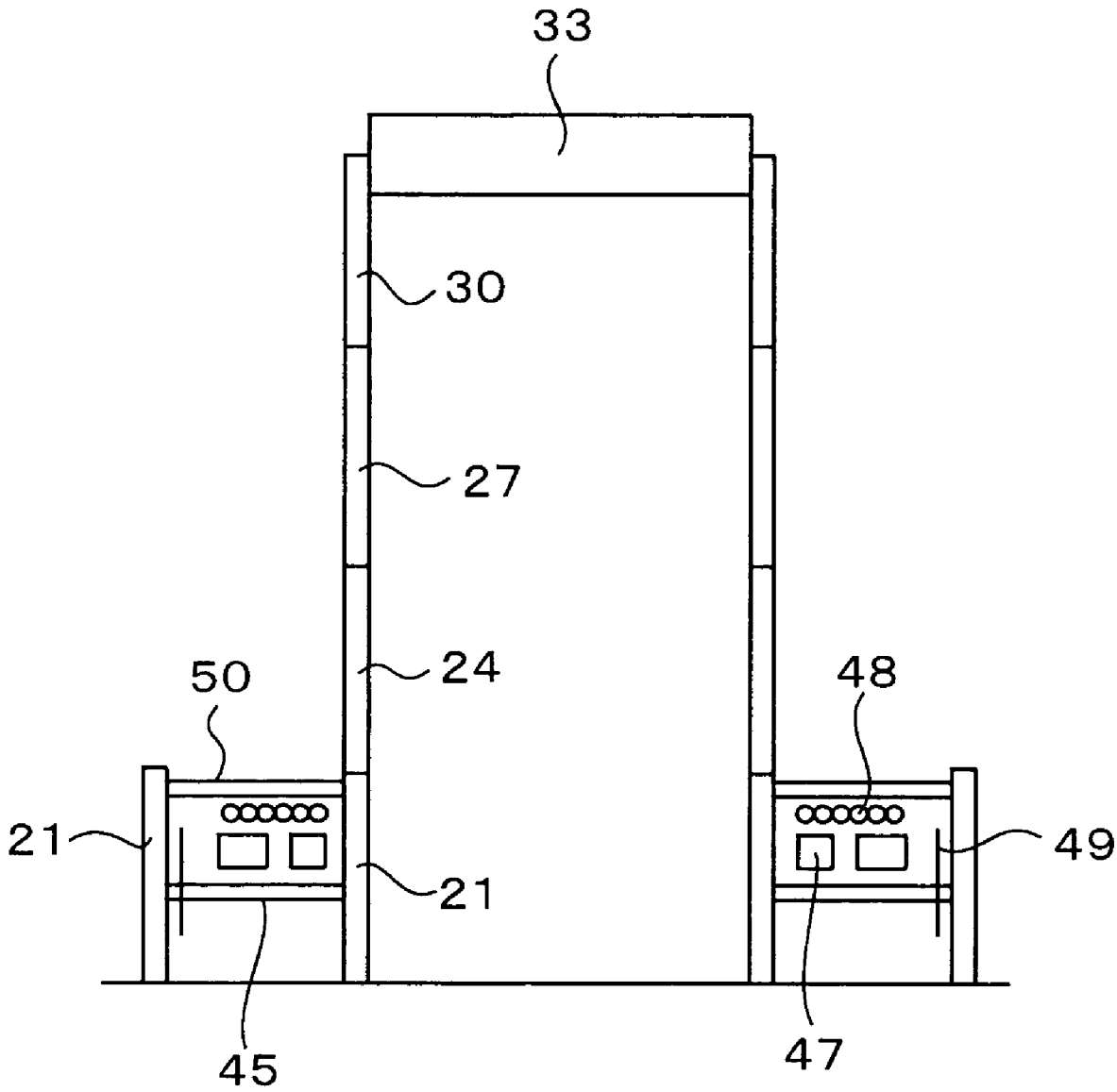
FIG. 2 is a view taken along line A-A in FIG. 1.

As shown in FIGS. 1 and 2, in the first zone 65, minimally required steel columns (first-level through fourth-level steel columns 21, 24, 27, 30) for suspending the boiler main unit are erected, first through eighth floor units 45, 50, 52, 53, 58, 59, 61, and 62 are installed between the minimally required steel columns (first-level through fourth-level steel columns 21, 24, 27, 30), and top girders 33 are disposed above the steel columns.

The minimally required steel columns (first-level through fourth-level steel columns 21, 24, 27, 30) for suspending the boiler main unit are the first-level through fourth-level steel columns 21, 24, 27, 30 at the width-wise center portion of the boiler building as shown in FIG. 2 for example, and at this point, of the first-level through fourth-level steel columns 21, 24, 27, and 30, which form the width-wise end portions, only the lowest first-level steel columns 21 have been erected, and the second-level through fourth-level steel columns 24, 27, and 30, are not yet erected.

The steel structure is made up of columns and beams, which are fastened at the joints thereof with, for example, L-shaped fasteners and bolts. The columns are vertically divided in to multiple sections, and are assembled on-site for use.

A floor unit has at least floor beams and a floor, and has been assembled beforehand, taking the hoisting limit load of the crane into consideration. Floors are laid on steel beams, and are configured of floor beams, grating, checker plate, or the like, each fixed by welding. Tie-ins are provided to the floor unit to facilitating tying in with the steel beams and columns. The tie-ins are used to dispose the floor units between the steel columns on each level.

The first-level steel columns 21, first floor unit 45, and second floor unit 50, are installed over the entire area of the first zone 65, serving to support and reinforce the second-level through fourth-level steel columns 24, 27, and 30.

A duct block 47, fuel pipe block 48, cable tray 49, mill 42, and so on forth, are carried in above the first floor unit 45, and installed. The duct block 47, fuel pipe block 48, and cable tray 49 may be carried in separately from or together with the first floor unit 45. For example, an arrangement wherein the floor unit 45 and the duct block 47 are integrally formed and carried in, or wherein the floor unit 45 and the fuel pipe block 48 are integrally formed and carried in, would have greater work efficiency.

Forming blocks such as the duct block 47 or the fuel pipe block 48, and integration thereof with the floor unit 45, are performed nearby the installation site, or in a plant.

Rectangular ducts are formed of casing in a box shape, with supports provided inside the ducts and thermal insulation and cladding sheets on the outside, and dampers and expansion joints provided along the way. Round ducts are formed of casing in a cylindrical shape, with thermal insulation and cladding sheets on the outside, and expansion joints provided along the way.

The duct block 47 has at least duct casing panels, internal supports, and dampers, and is configured beforehand in a block form so as to be within the hoisting limit load of the crane.

Fuel pipes are configured of straight piping, bent piping, joints for connection thereof, and supports for supporting these with the steel structure. The fuel pipe block 48 has at least fuel pipes and supporting devices (supporting members) thereof, and is configured beforehand in a block form so as to be within the hoisting limit load of the crane.

Figure 3:
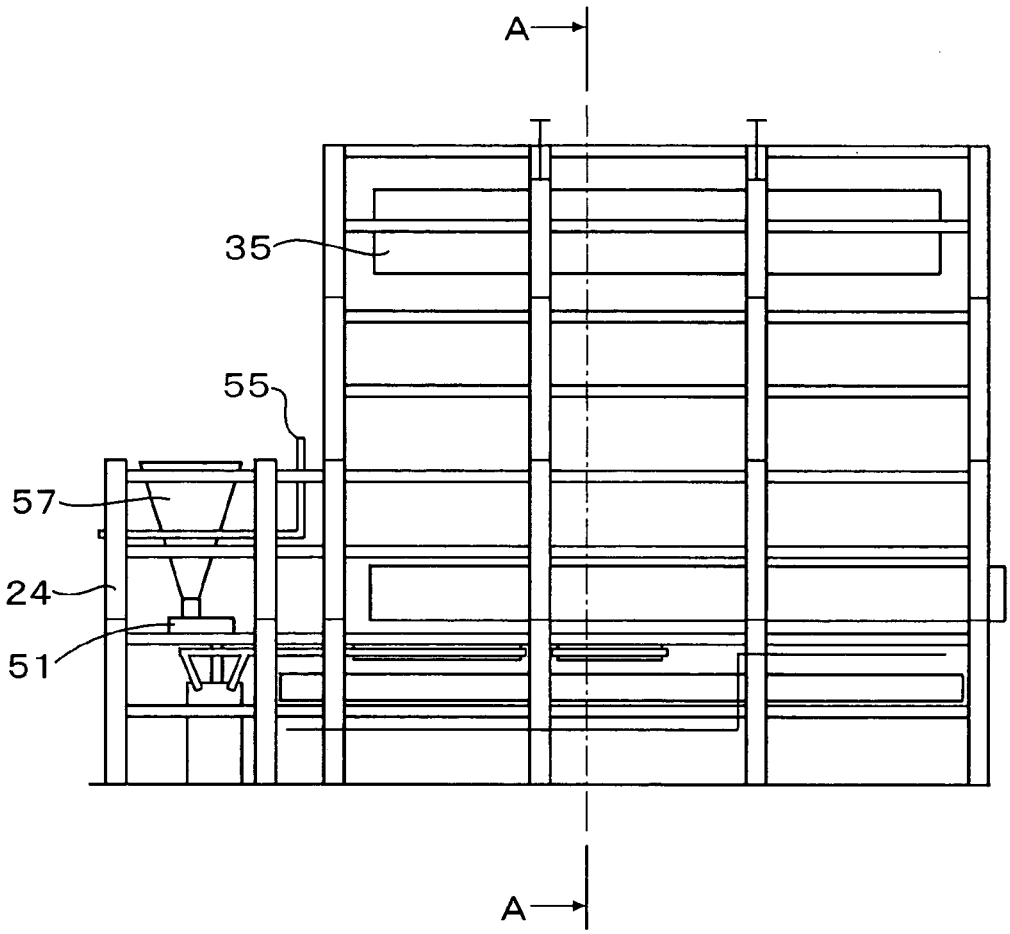
FIG. 3 is a schematic configuration diagram for describing the boiler facilities installation construction method according to an embodiment of the invention.
Figure 4:
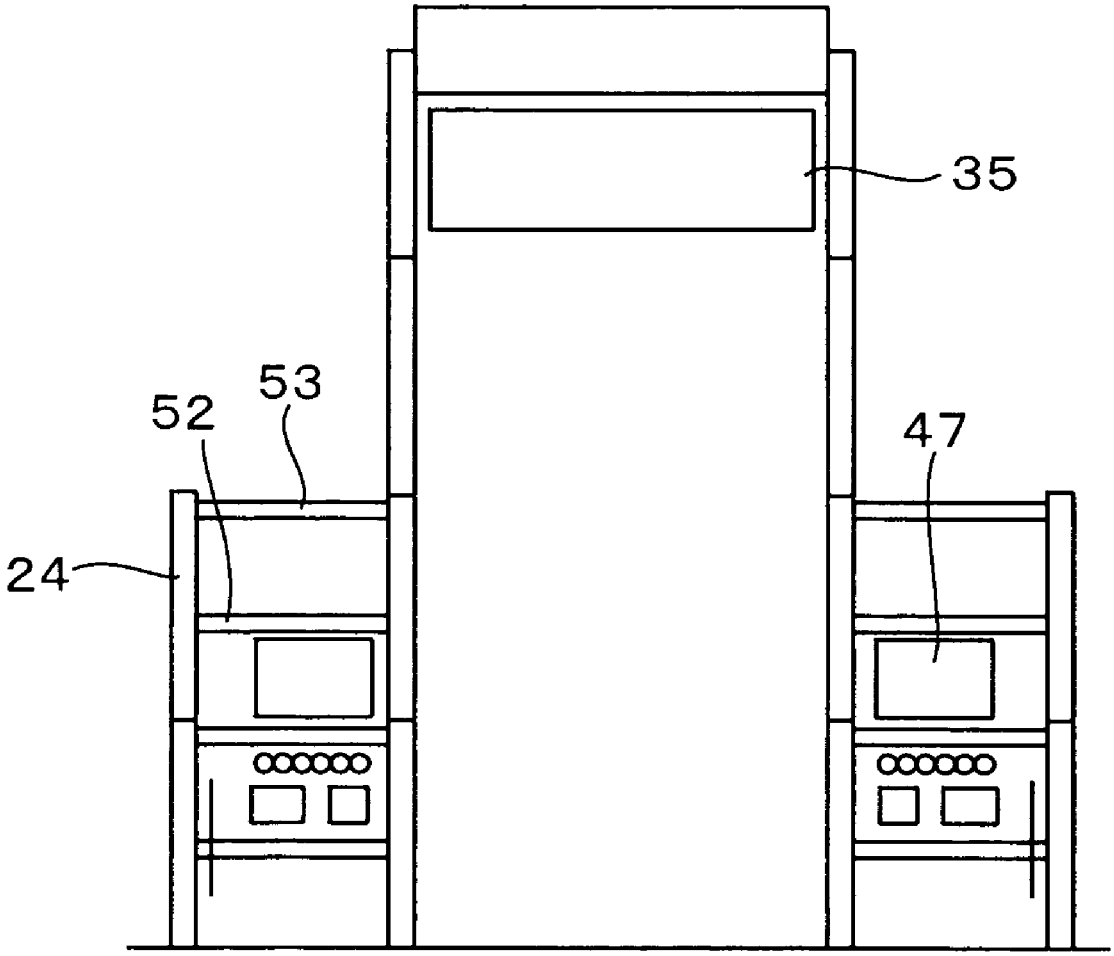
FIG. 4 is a view taken along line A-A in FIG. 3.

As shown in FIGS. 3 and 4, the upper portion of the boiler main unit 35 is suspended from the top girders 33 by sling bolts, the remainder of the second-level steel columns 24 are erected, and the duct block 47 and stoker 51 are carried in and attached above the second floor unit 50. Subsequently, a third floor unit 52 and fourth floor unit 53 are disposed between the second-level steel columns 24, and a bunker cone block 57, piping 55, and so forth, are carried in and installed.

The bunker block 54 (the bunker cone block 57 and later-described bunker cylinder block 60) is made up of bunker components assembled beforehand in a ring-like form, taking the hoisting limit load of the crane into consideration.

The piping 55 is in a long shape, fabricated so as to be within a length that would allow for transportation between the factory and the site.

Figure 5:
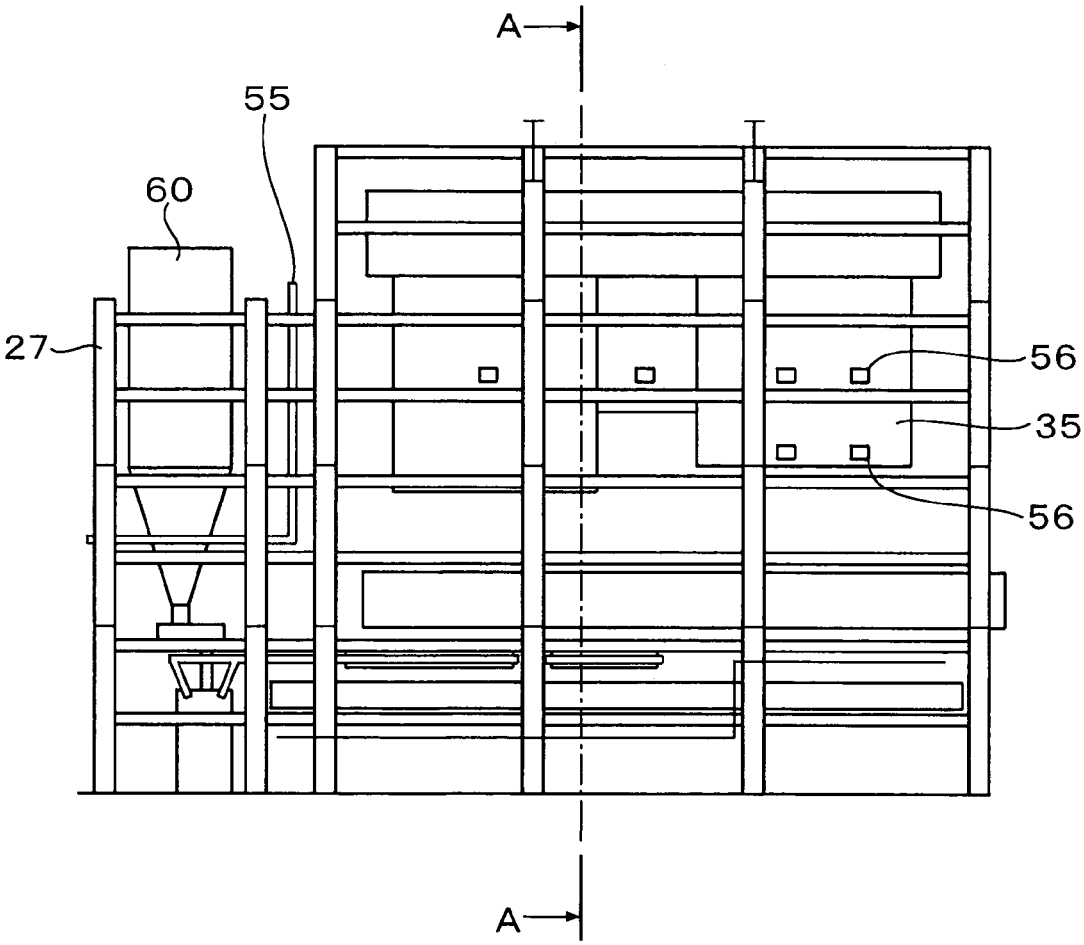
FIG. 5 is a schematic configuration diagram for describing the boiler facilities installation construction method according to an embodiment of the invention.
Figure 6:
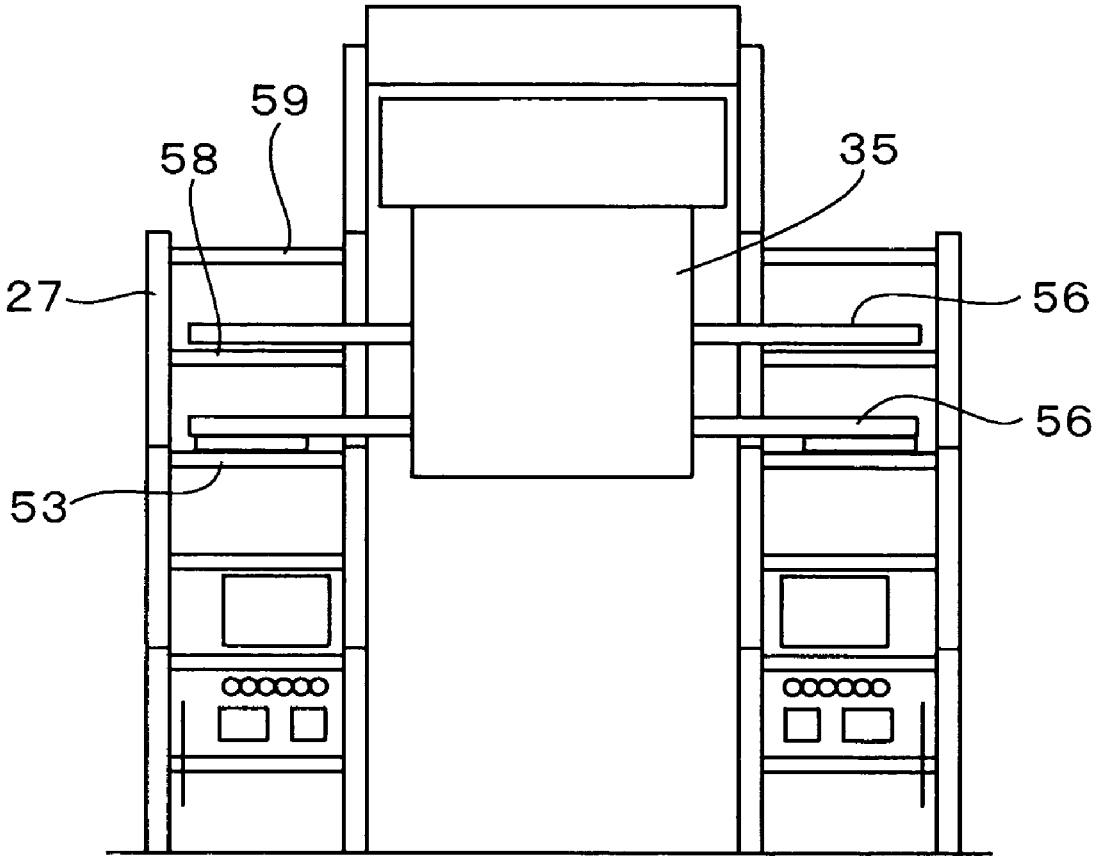
FIG. 6 is a view taken along line A-A in FIG. 5.

As shown in FIGS. 5 and 6, the middle portion of the boiler main unit 35 is suspended from the top girders 33, and following installing the soot blower 56 on the fourth floor unit 53, the remainder of the third-level steel columns 27 are erected, and the fifth floor unit 58 and sixth floor unit 59 are disposed between the third-level steel columns 27. Piping 55, soot blower 56, bunker cylinder block 60, and so on forth, are then carried in and installed.

Figure 7:
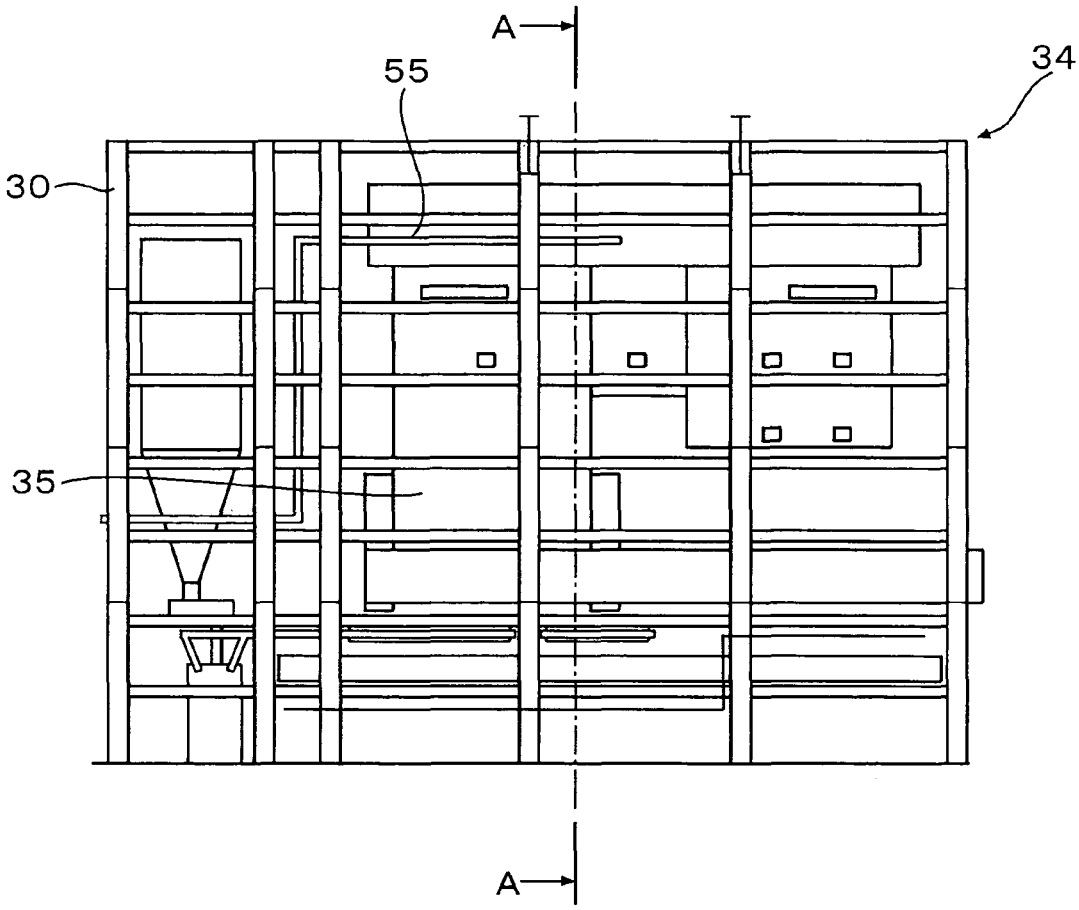
FIG. 7 is a schematic configuration diagram for describing the boiler facilities installation construction method according to an embodiment of the invention.
Figure 8:
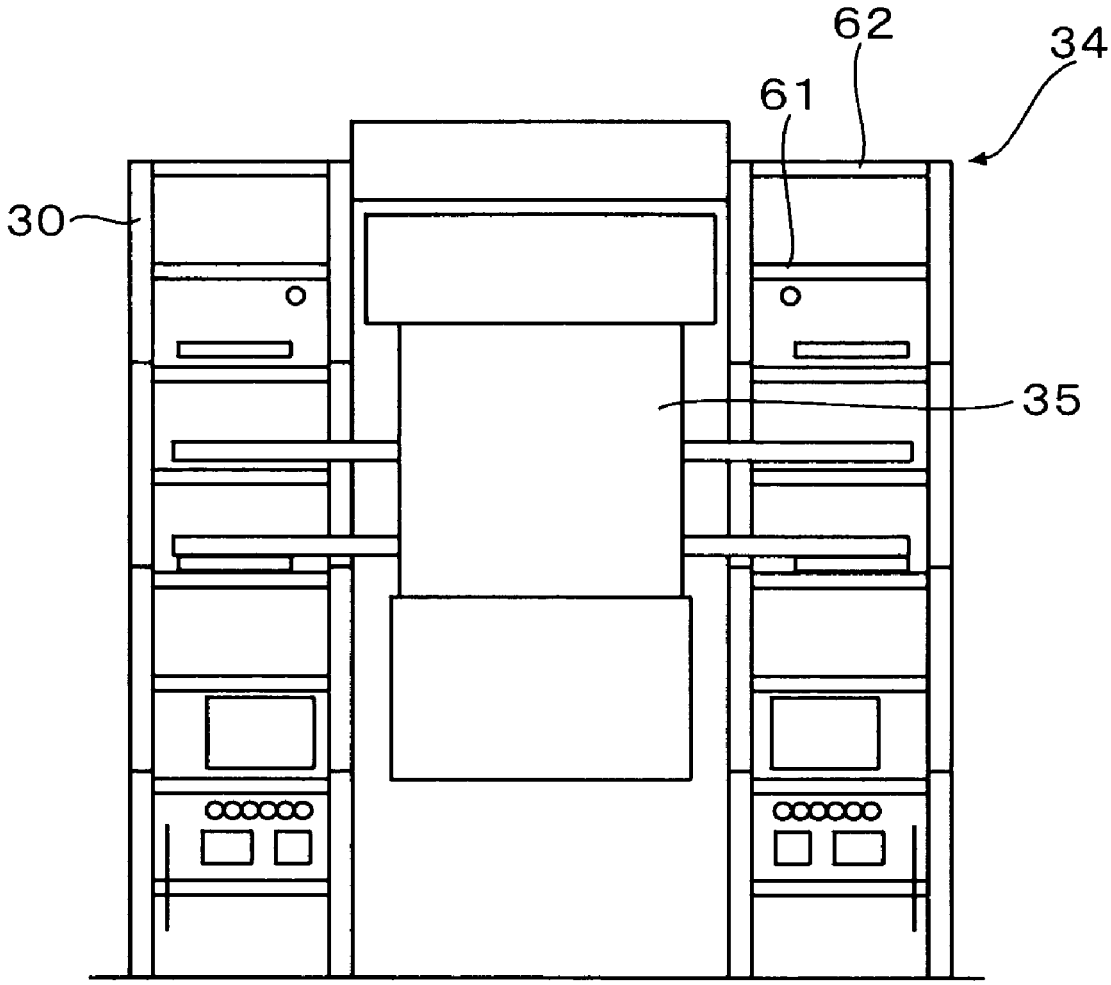
FIG. 8 is a view taken along line A-A in FIG. 7.

As shown in FIGS. 7 and 8, the lower portion of the boiler main unit 35 is suspended from the top girders 33, the remainder of the fourth-level steel columns 30 are erected, the seventh floor unit 61 and eighth floor unit 62 are disposed between the fourth-level steel columns 30, and piping 55 and the like is carried in and installed, thereby completing the boiler building 34.

Figure 9:
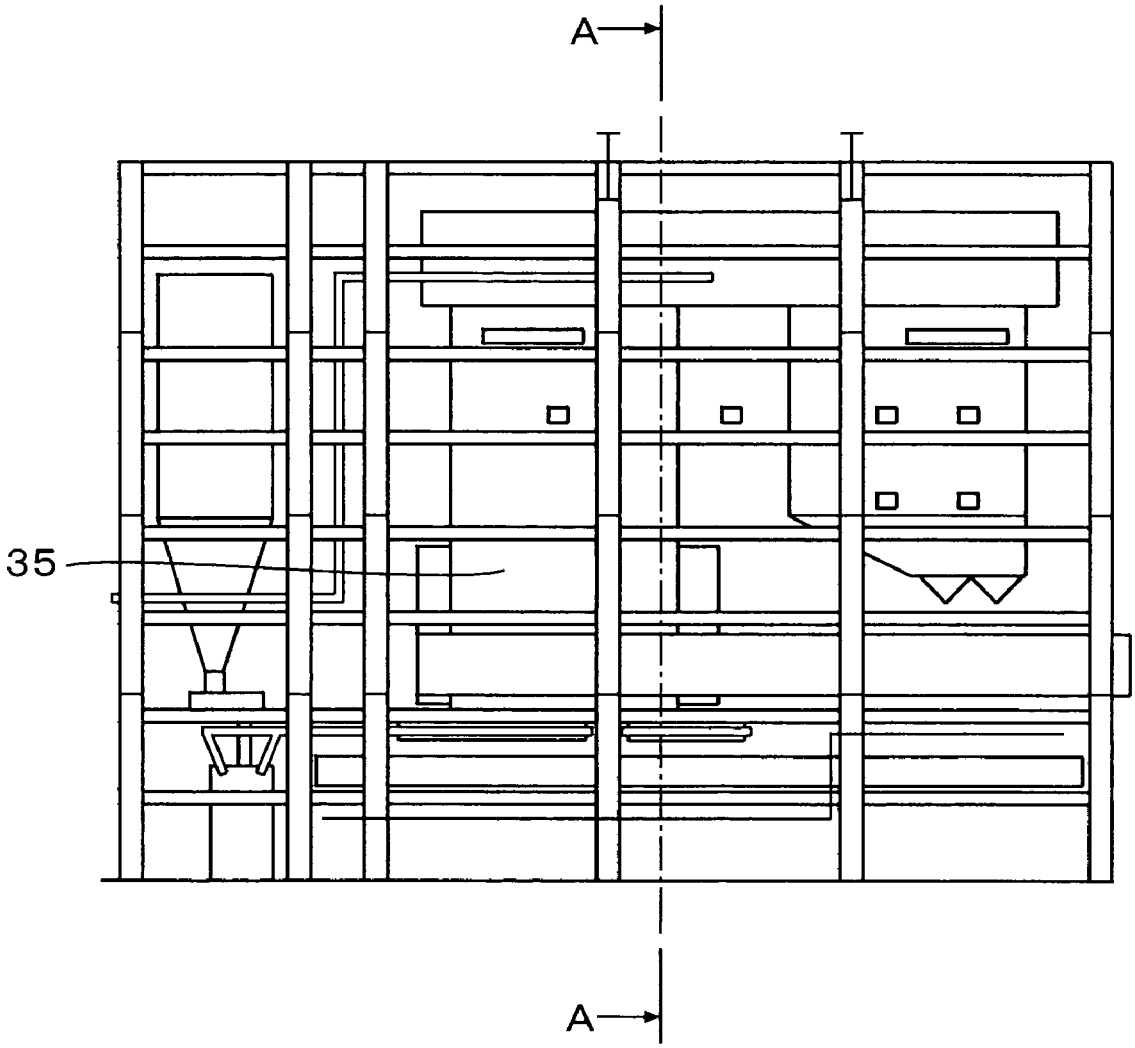
FIG. 9 is a schematic configuration diagram for describing the boiler facilities installation construction method according to an embodiment of the invention.
Figure 10:
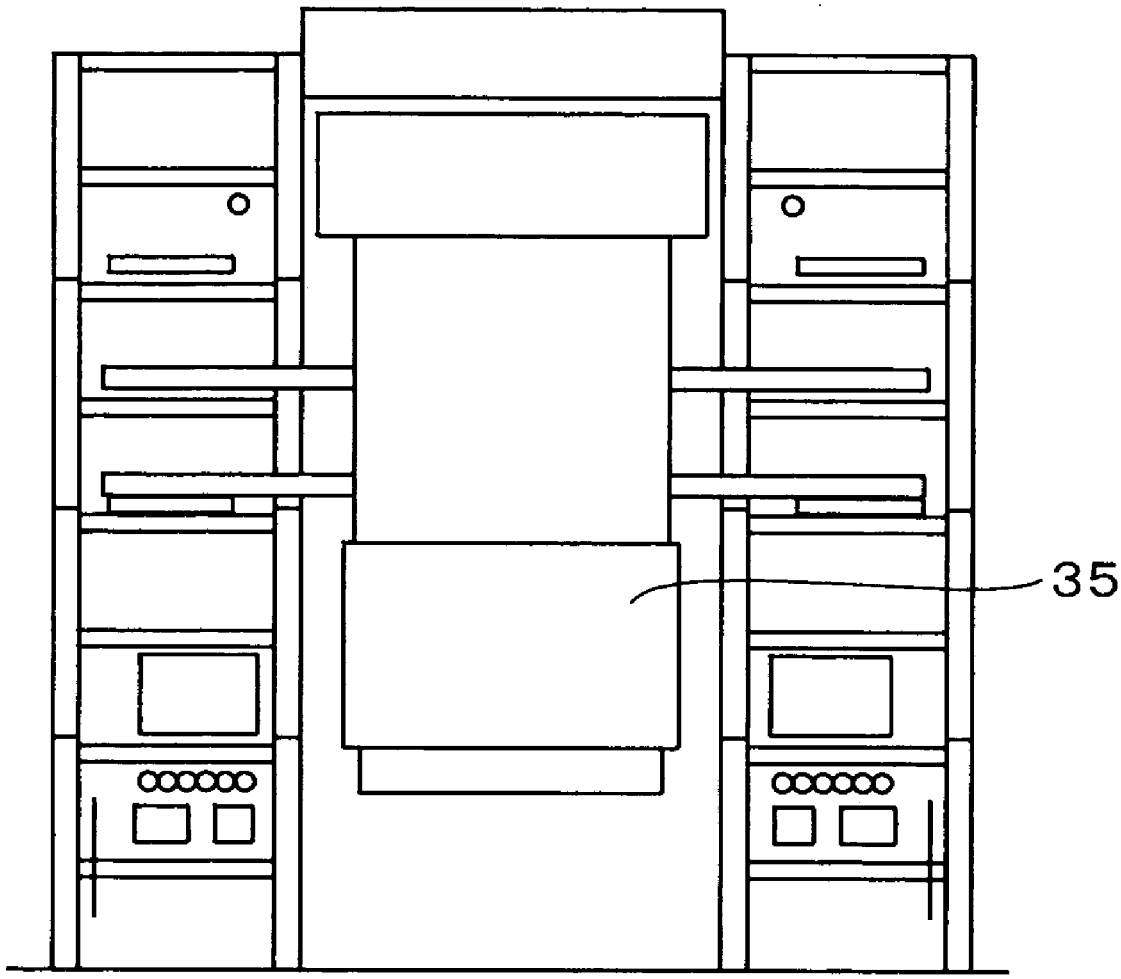
FIG. 10 is a view taken along line A-A in FIG. 9.
Figure 11:
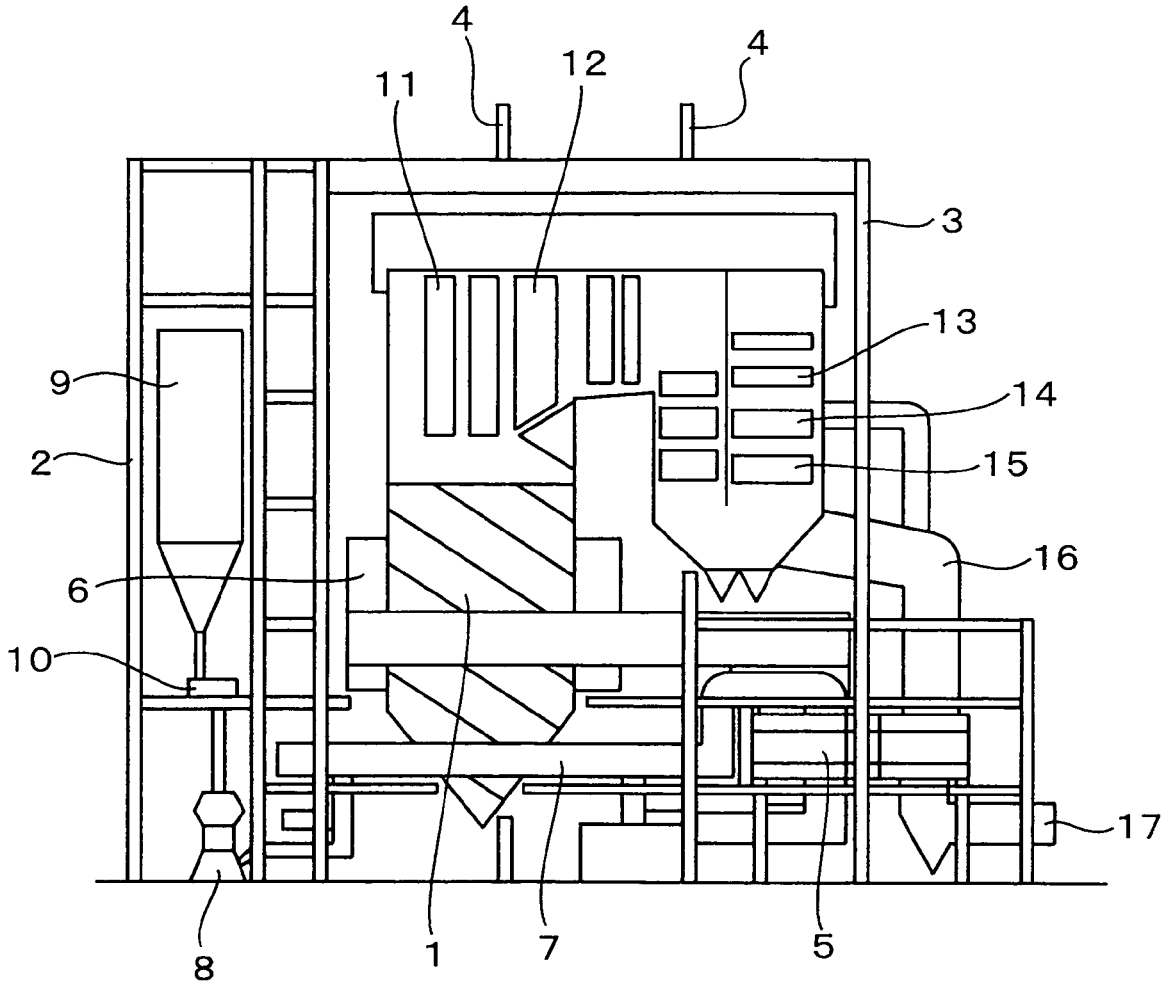
FIG. 11 is a schematic configuration diagram of boiler facilities.
Figure 12:
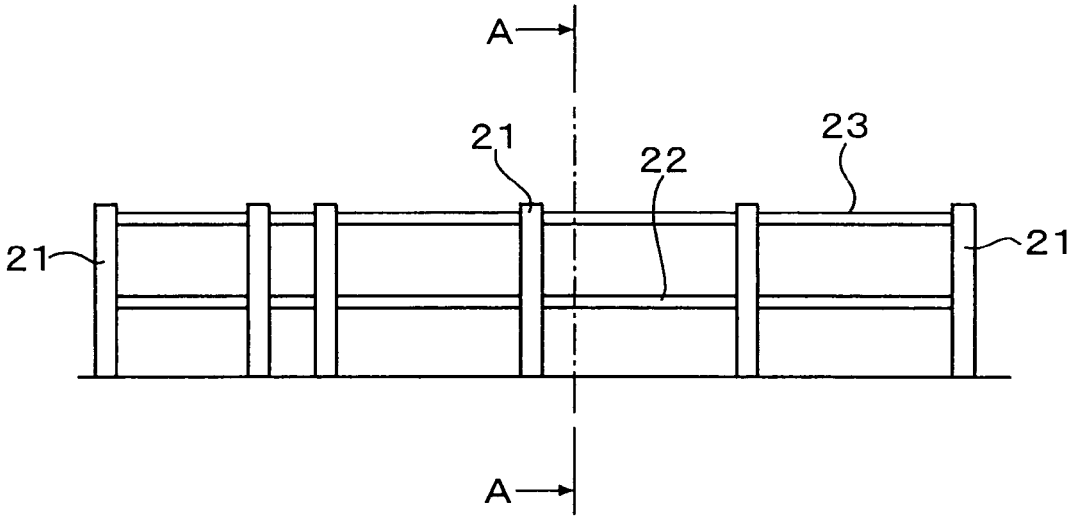
FIG. 12 PRIOR ART
FIG. 12 is a schematic configuration diagram for describing a conventional boiler facilities installation construction method.
Figure 13:
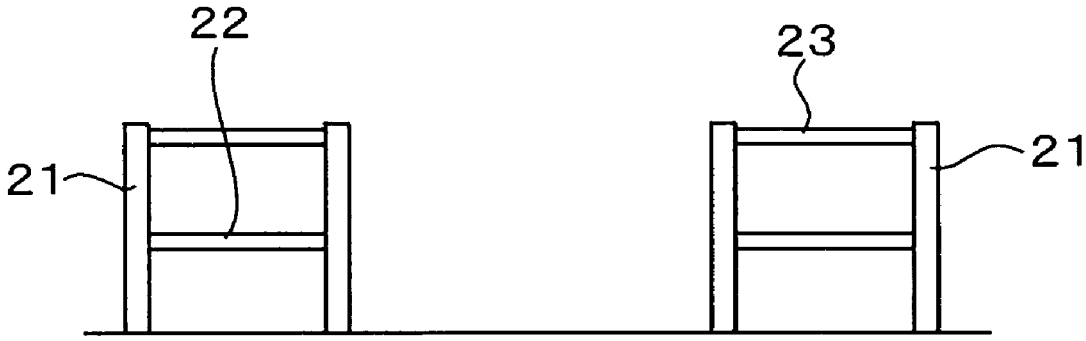
FIG. 13 PRIOR ART
FIG. 13 is a view taken along line A-A in FIG. 12.
Figure 14:
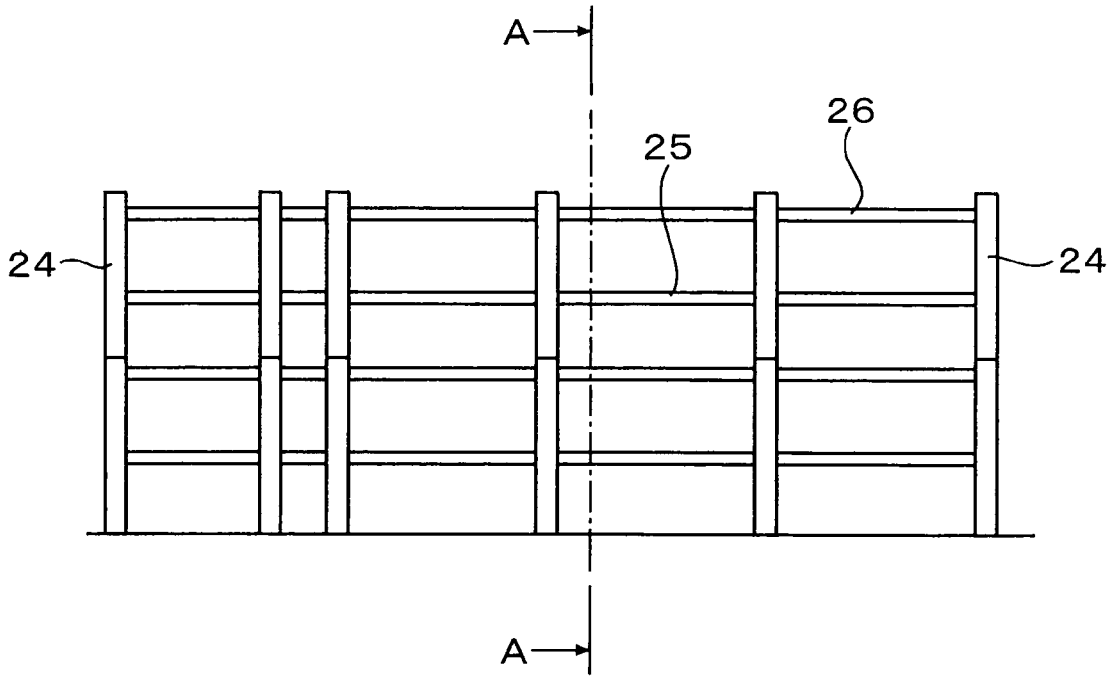
FIG. 14 PRIOR ART
FIG. 14 is a schematic configuration diagram for describing a conventional boiler facilities installation construction method.
Figure 15:
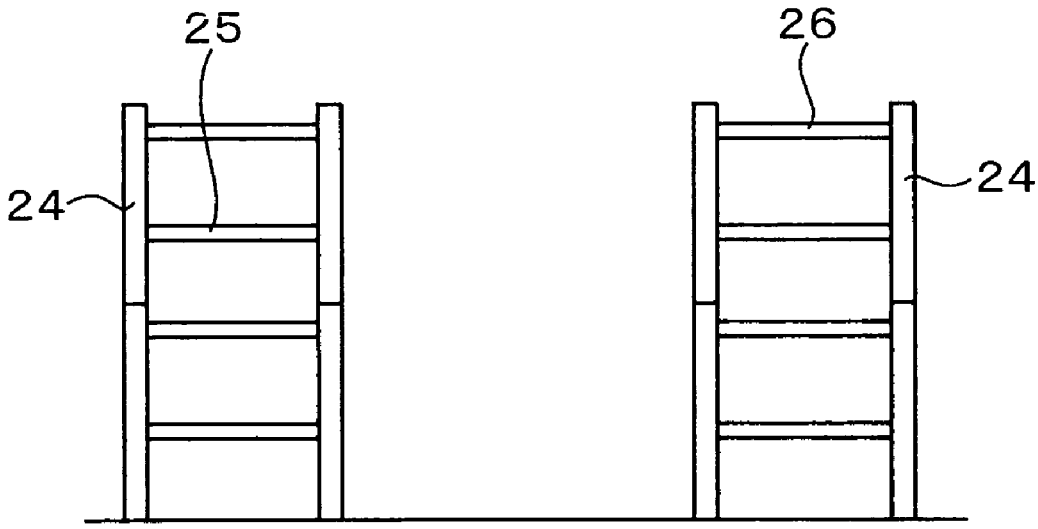
FIG. 15 PRIOR ART
FIG. 15 is a view taken along line A-A in FIG. 14.
Figure 16:
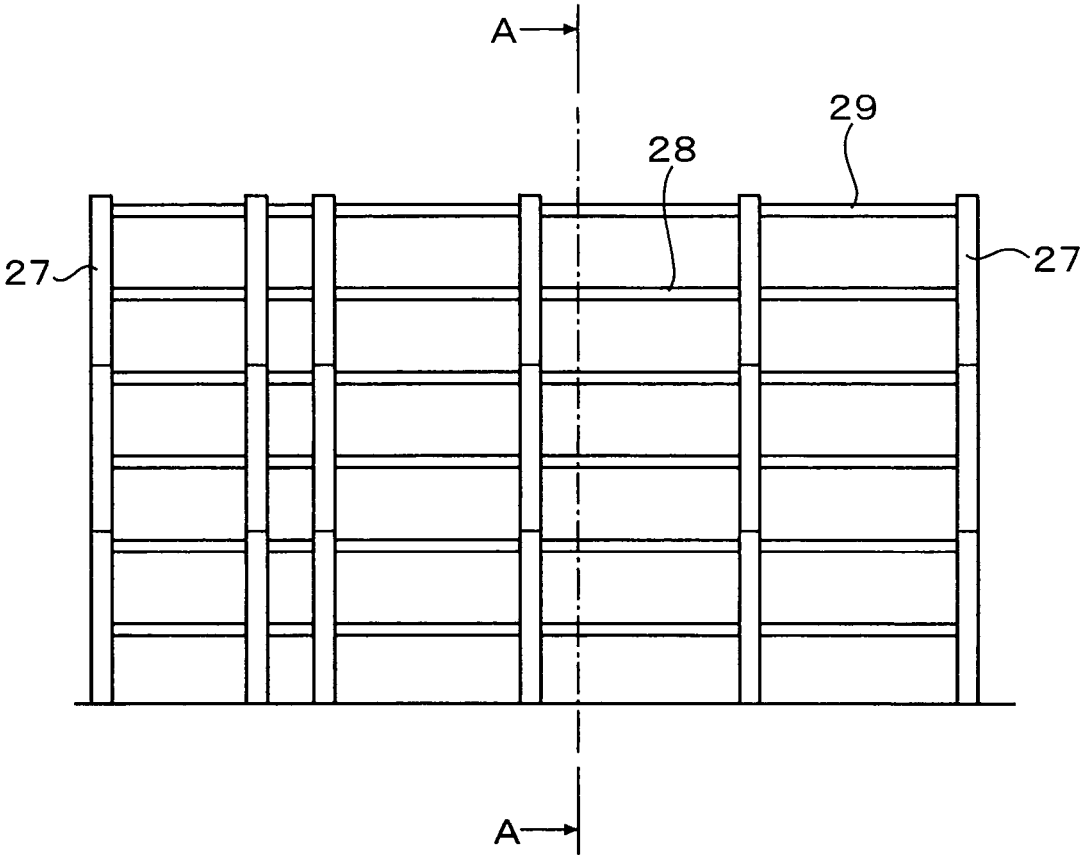
FIG. 16 PRIOR ART
FIG. 16 is a schematic configuration diagram for describing a conventional boiler facilities installation construction method.
Figure 17:
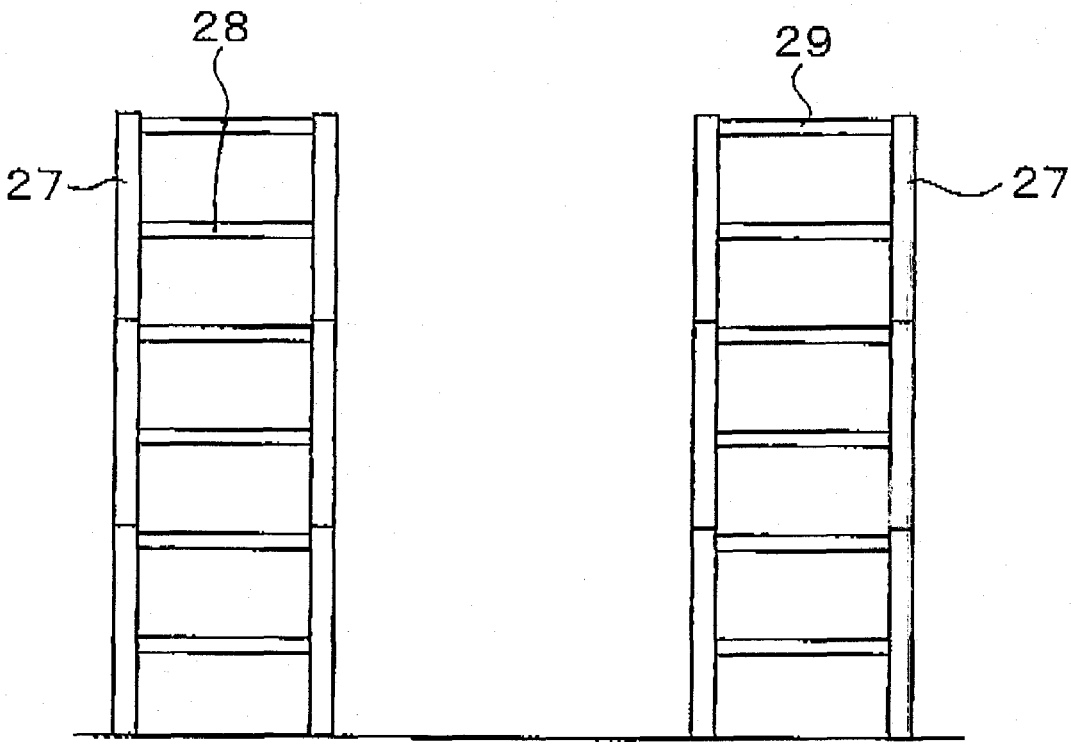
FIG. 17 PRIOR ART
FIG. 17 is a view taken along line A-A in FIG. 16.
Figure 18:
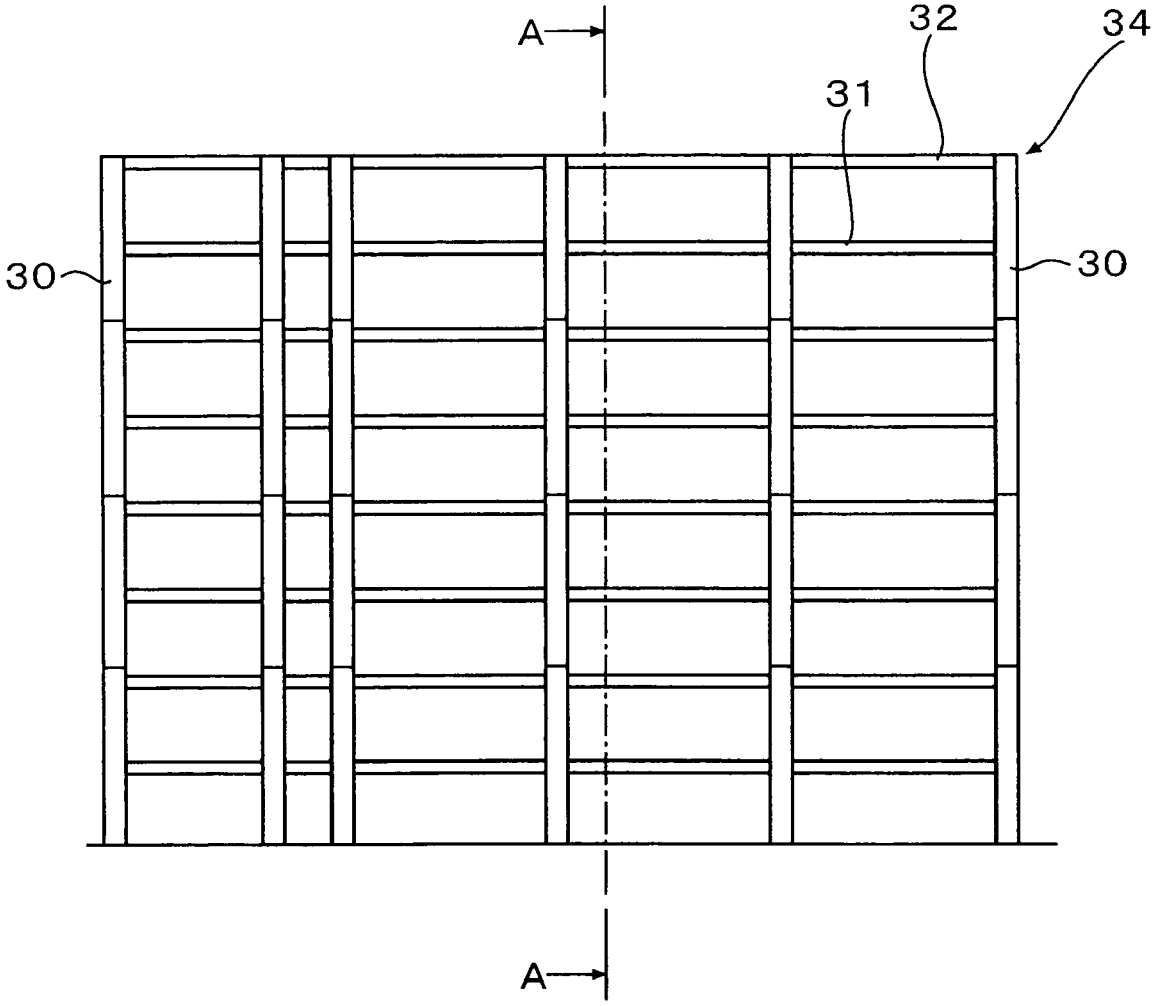
FIG. 18 PRIOR ART
FIG. 18 is a schematic configuration diagram for describing a conventional boiler facilities installation construction method.
Figure 19:
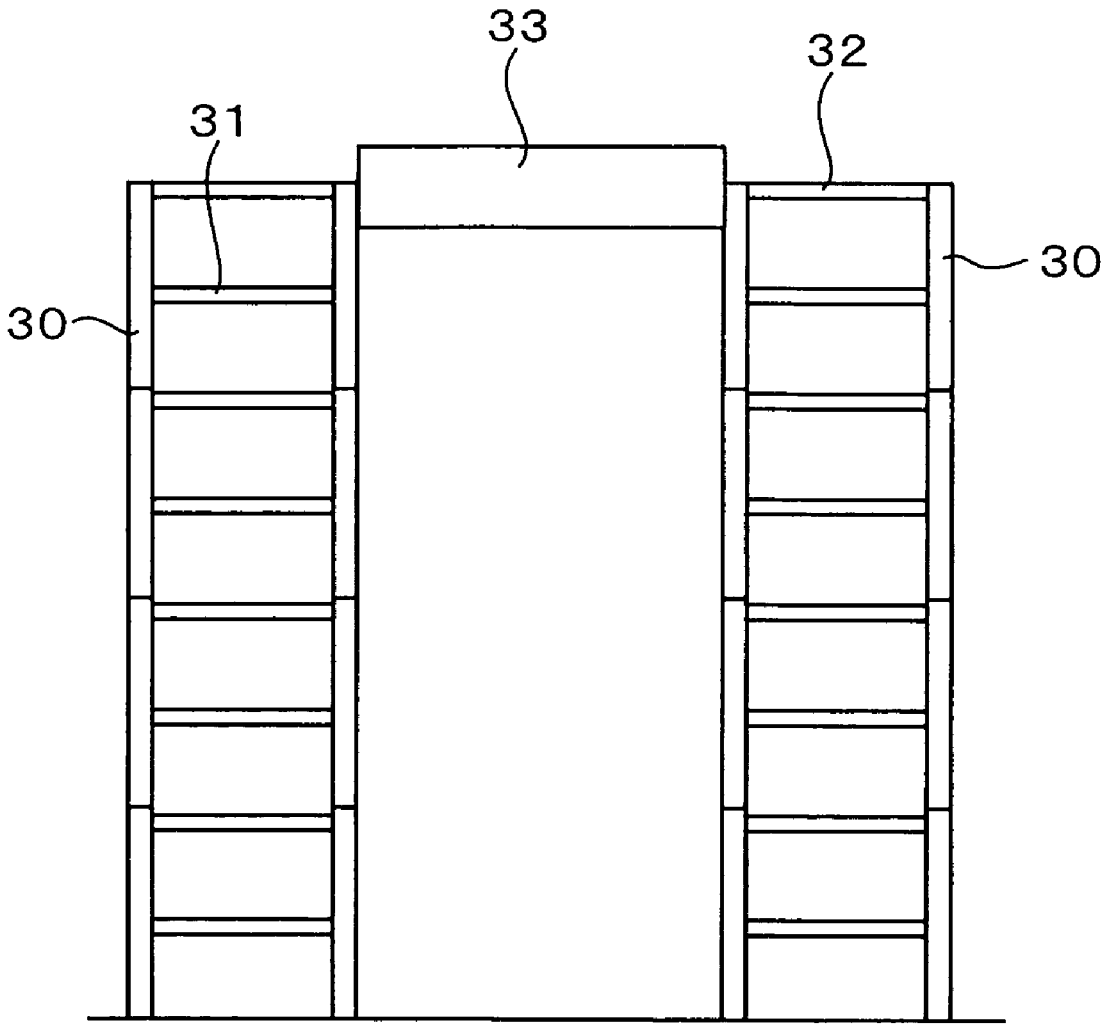
FIG. 19 PRIOR ART
FIG. 19 is a view taken along line A-A in FIG. 18.
Figure 20:
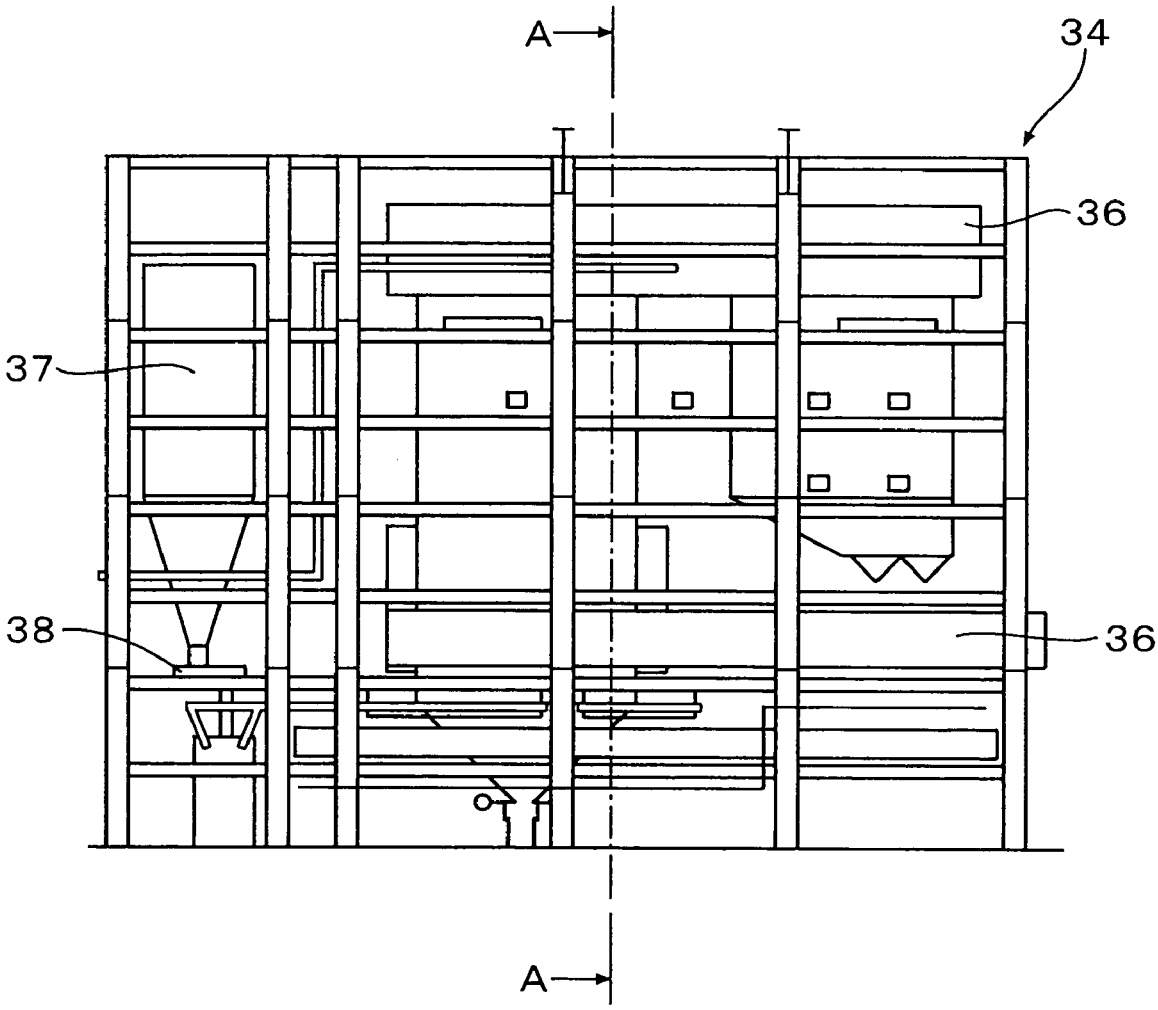
FIG. 20 PRIOR ART
FIG. 20 is a schematic configuration diagram for describing a conventional boiler facilities installation construction method.
Figure 21:
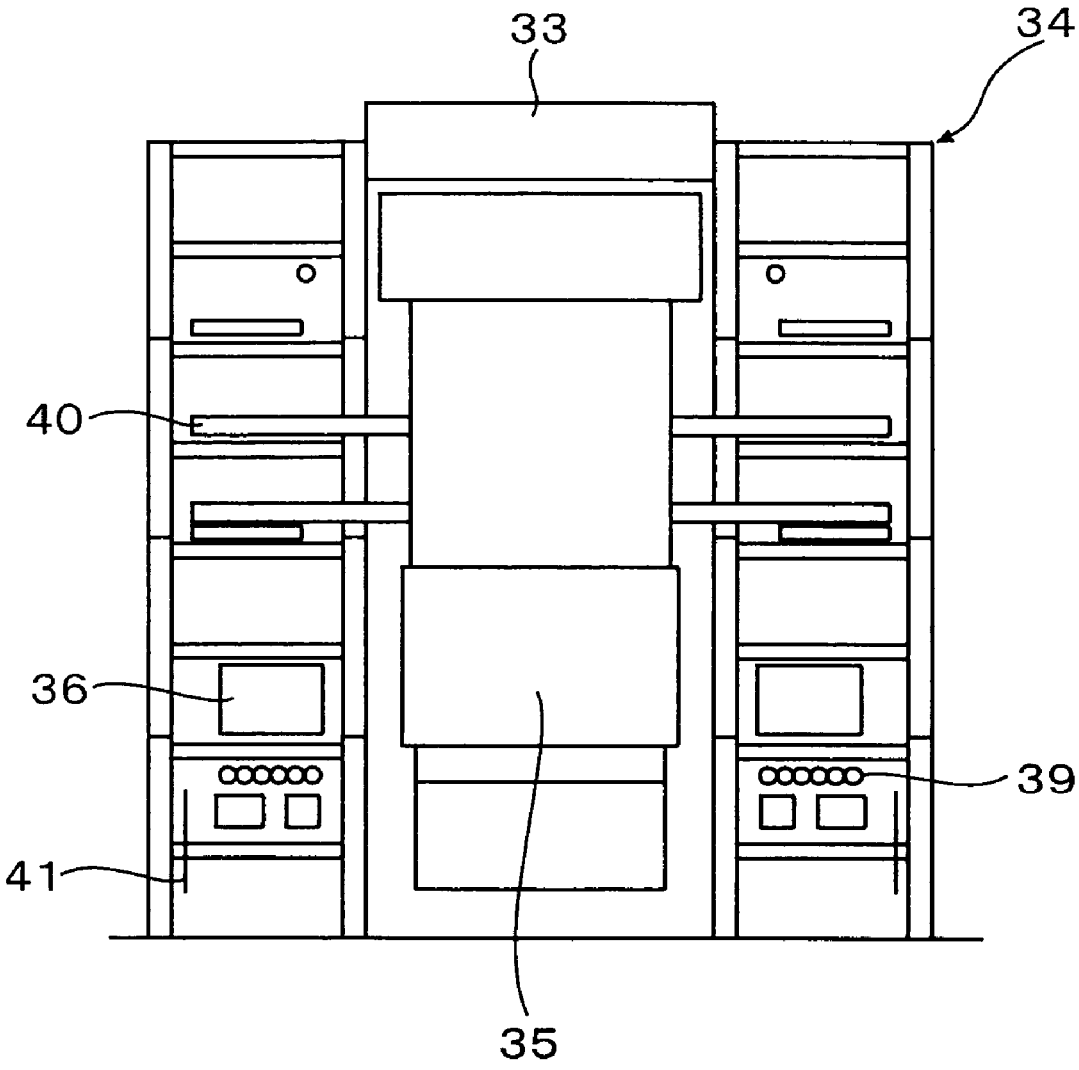
FIG. 21 PRIOR ART
FIG. 21 is a view taken along line A-A in FIG. 20.
Figure 22:
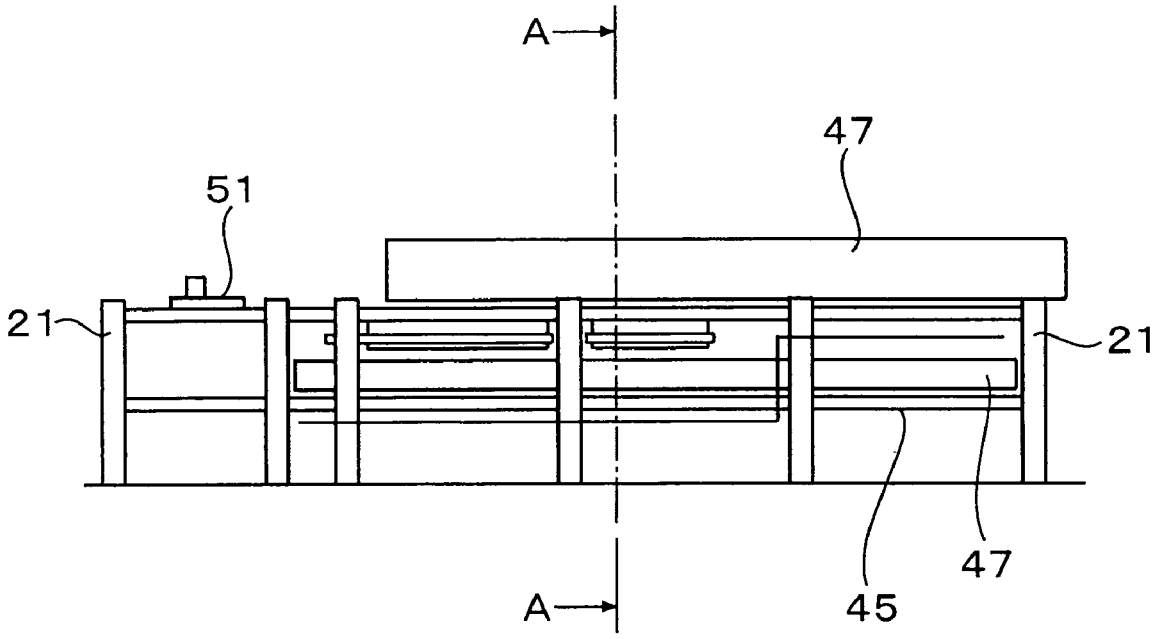
FIG. 22 is a schematic configuration diagram for describing a boiler facilities installation construction method previously studied.
Figure 23:
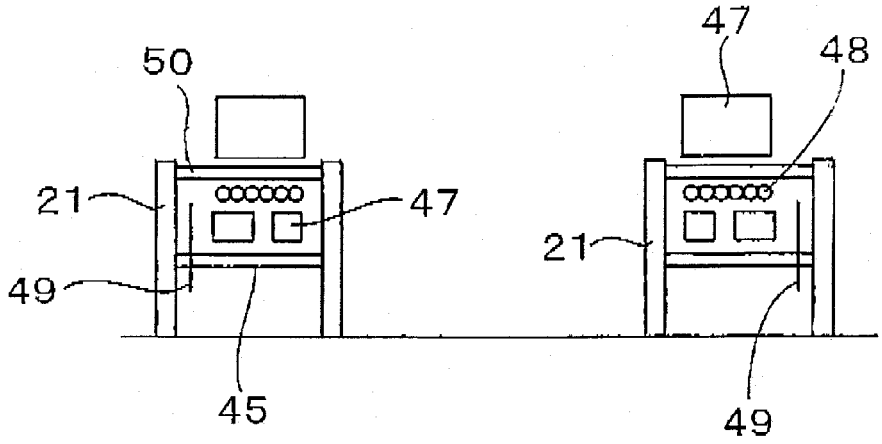
FIG. 23 is a view taken along line A-A in FIG. 22.
Figure 24:
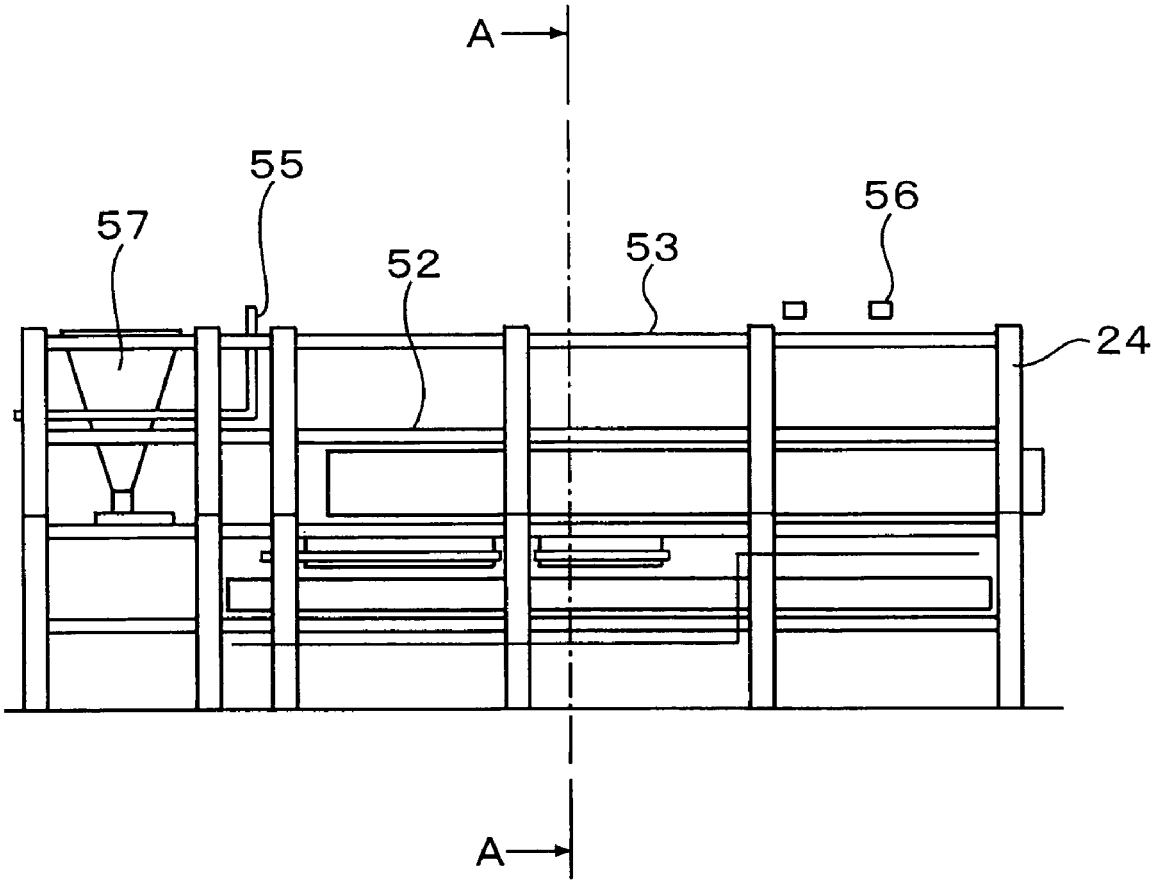
FIG. 24 is a schematic configuration diagram for describing a boiler facilities installation construction method previously studied.
Figure 25:
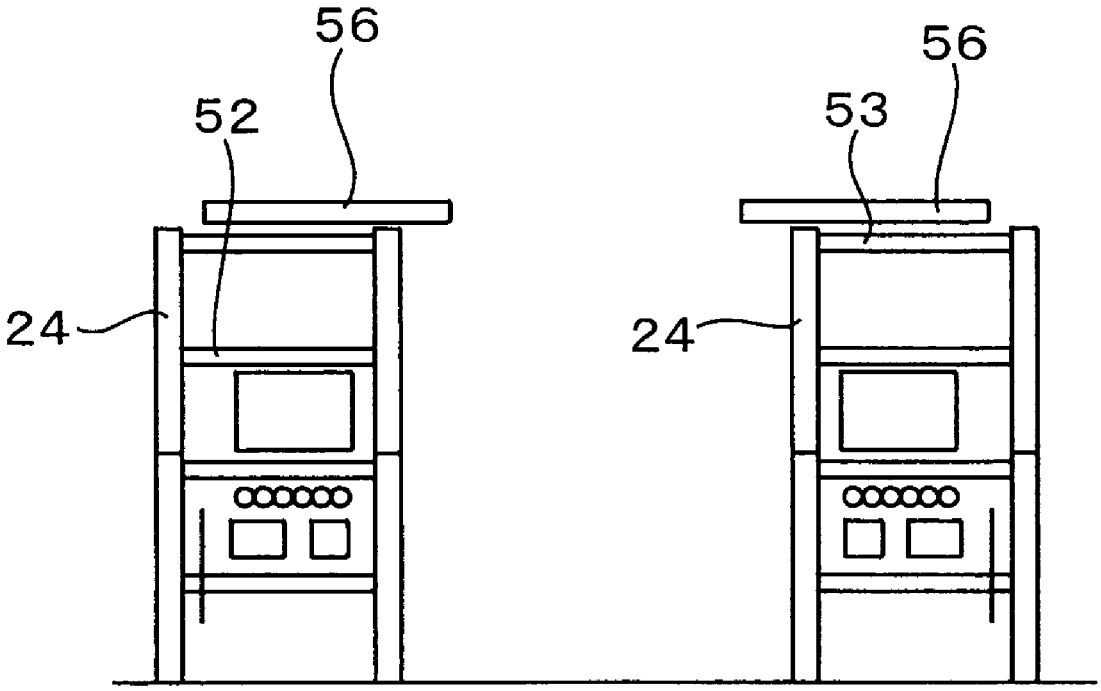
FIG. 25 is a view taken along line A-A in FIG. 24.
Figure 26:
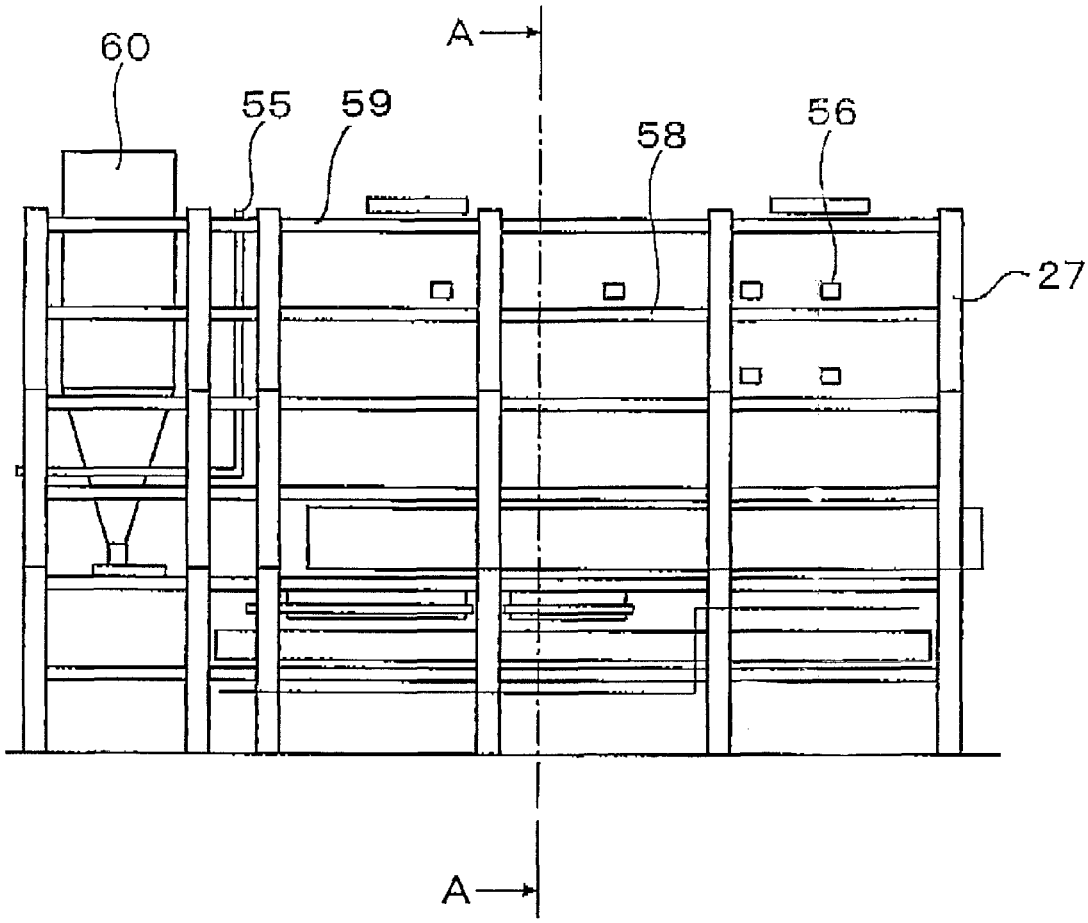
FIG. 26 is a schematic configuration diagram for describing a boiler facilities installation construction method previously studied.
Figure 27:
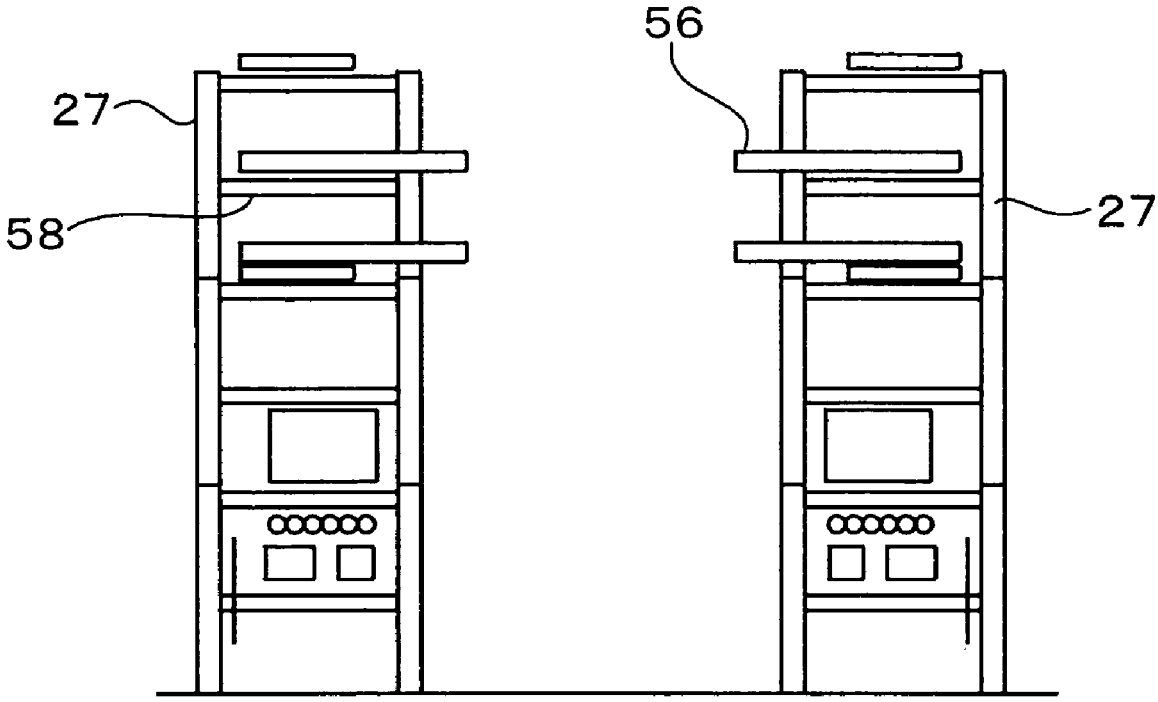
FIG. 27 is a view taken along line A-A in FIG. 26.
Figure 28:
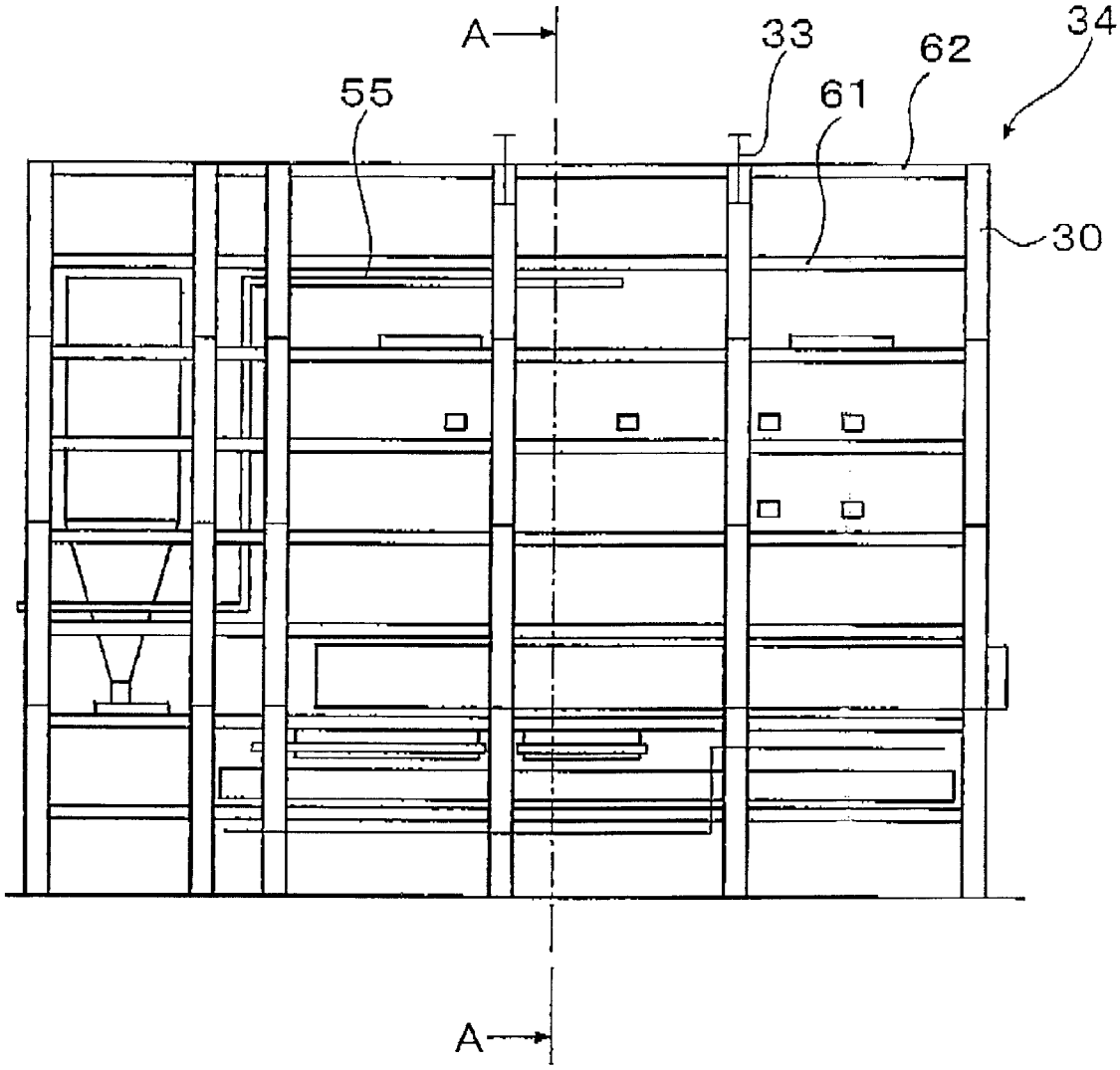
FIG. 28 is a schematic configuration diagram for describing a boiler facilities installation construction method previously studied.
Figure 29:
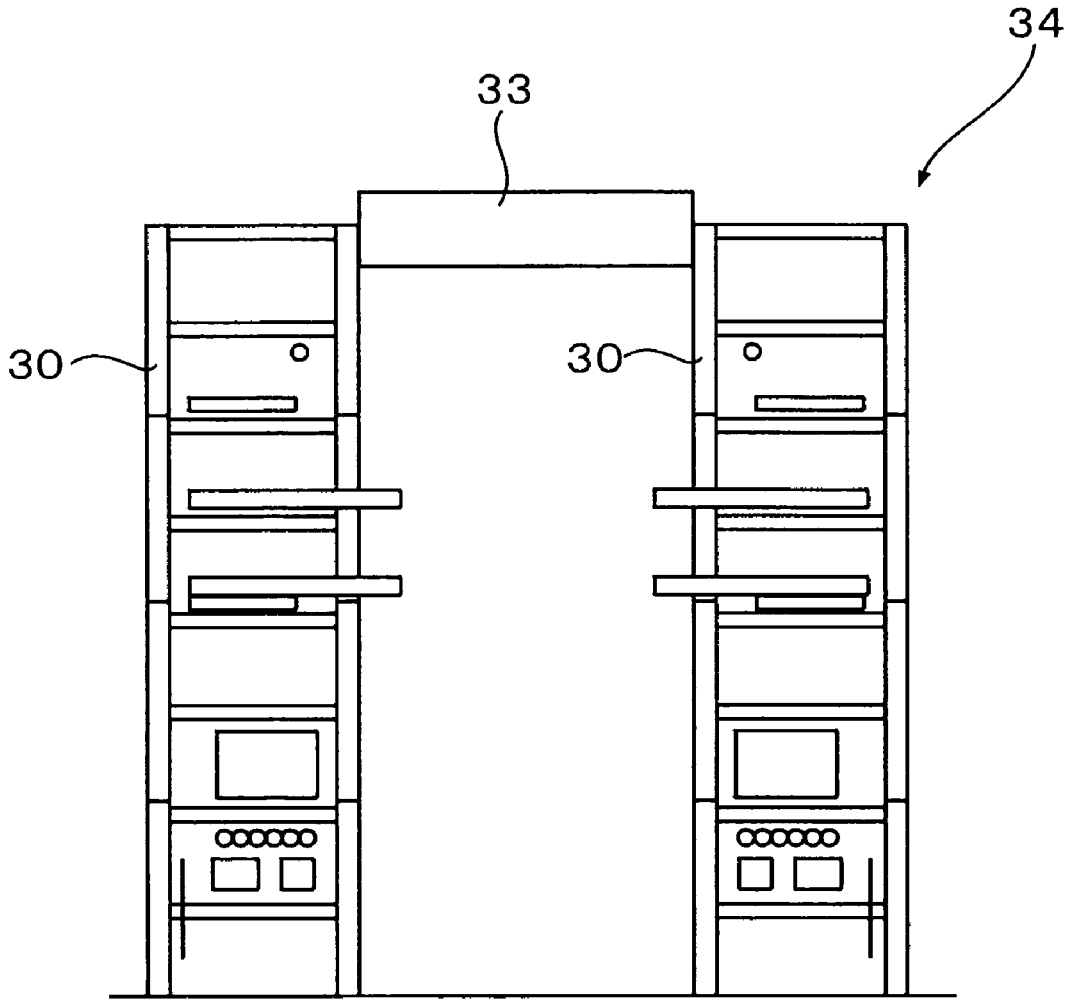
FIG. 29 is a view taken along line A-A in FIG. 28.
Figure 30:
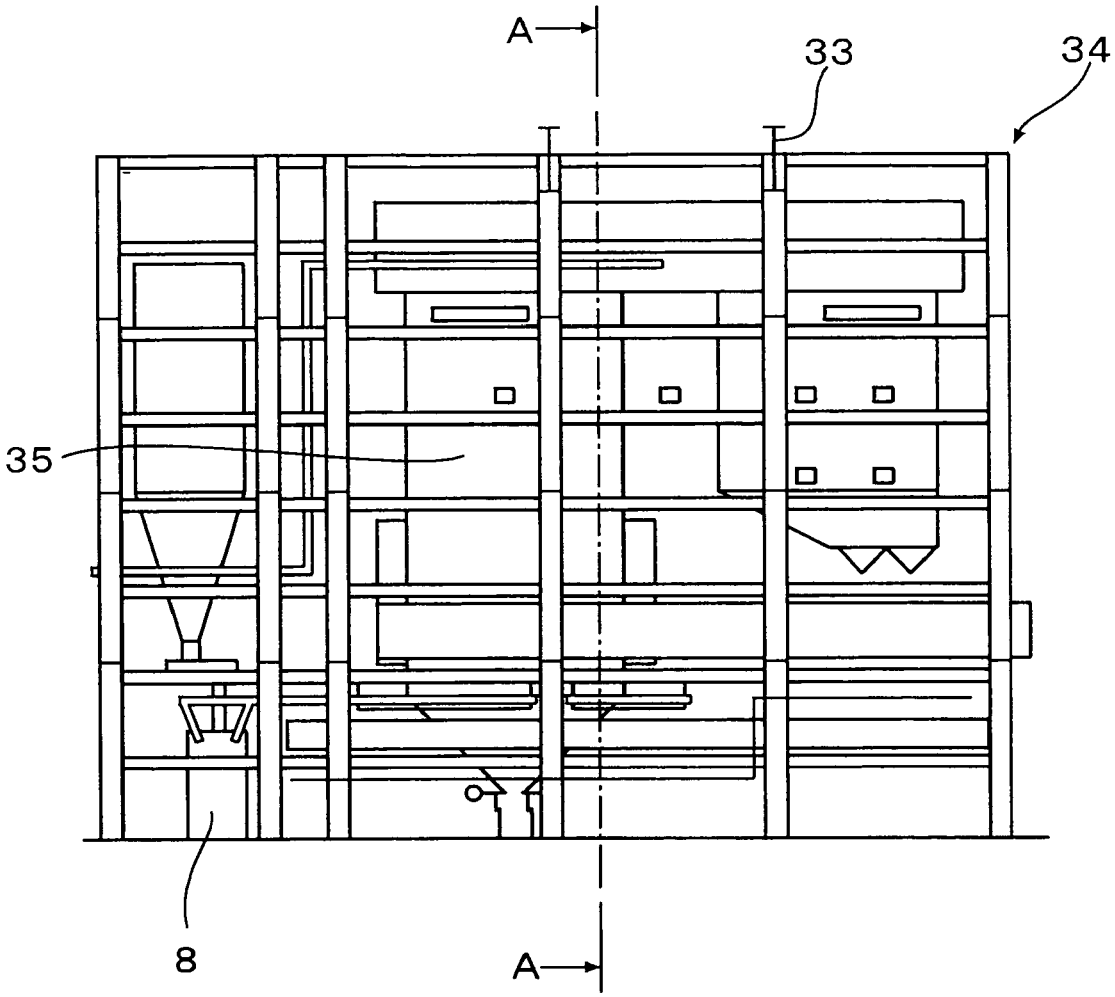
FIG. 30 is a schematic configuration diagram for describing a boiler facilities installation construction method previously studied.
Figure 31:
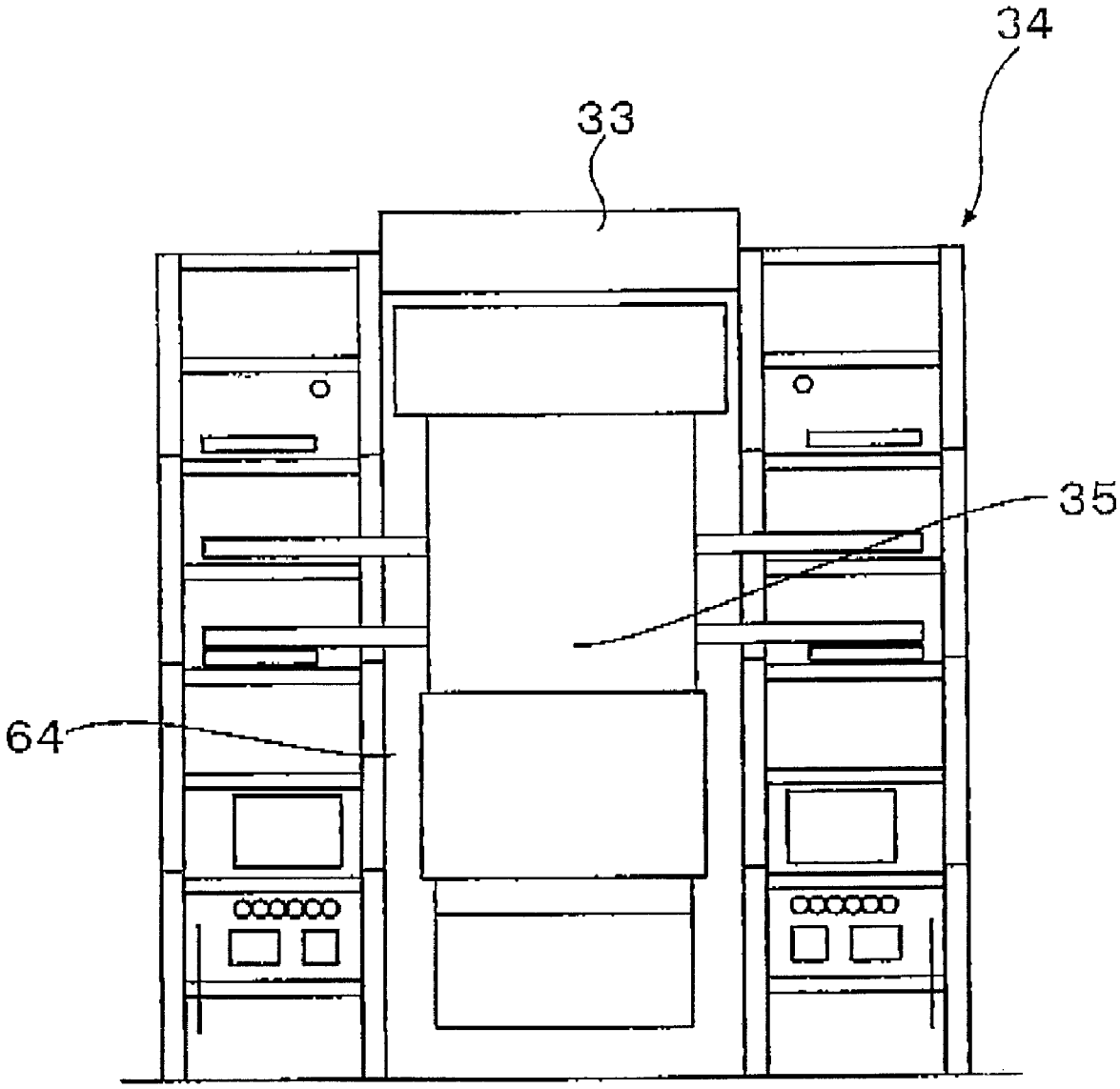
FIG. 31 is a view taken along line A-A in FIG. 30.
Figure 32:
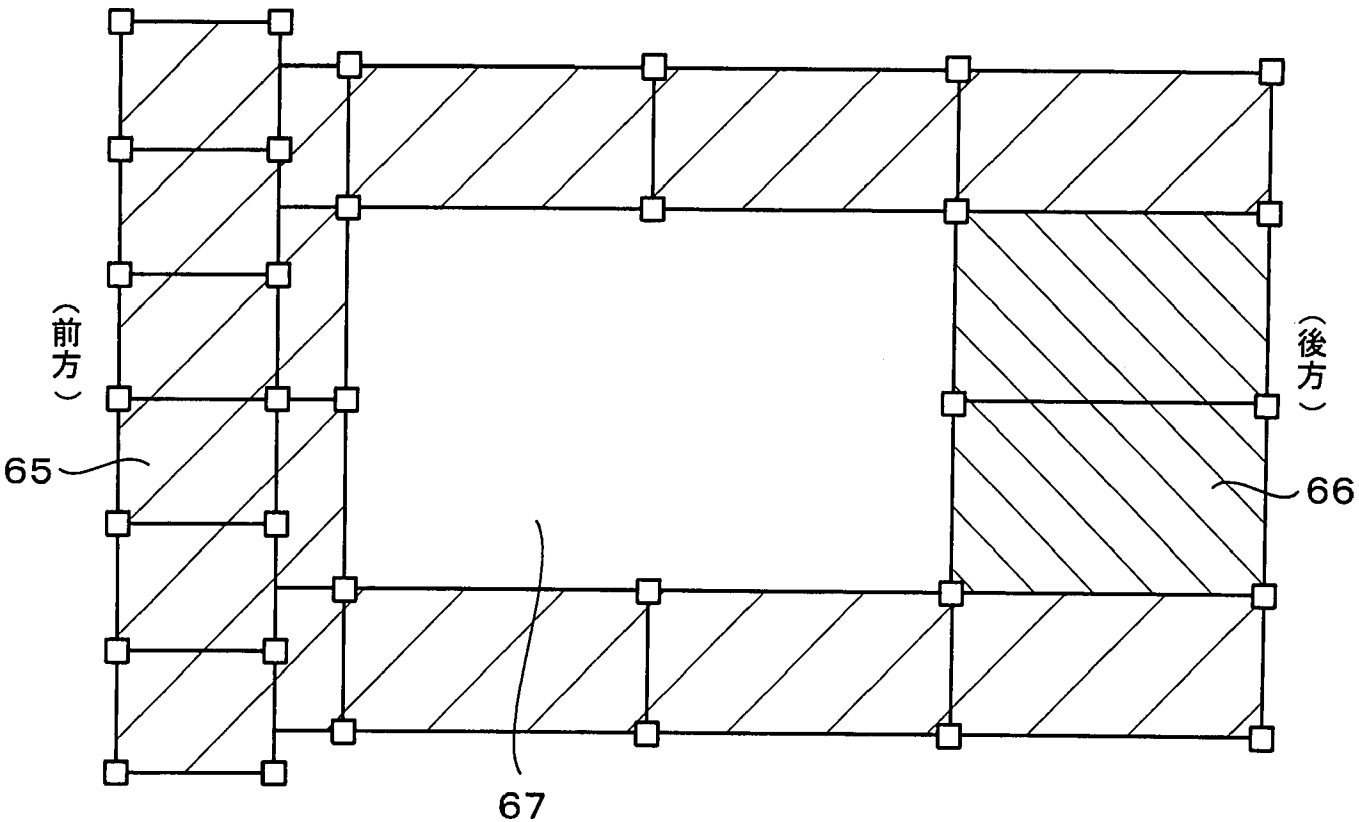
FIG. 32 is a schematic plan view illustrating the various zones in the boiler facilitates.

As shown in FIGS. 9 and 10, the final portion of the boiler main unit 35 is suspended, and subsequently the economizer discharge gas duct, air pre-heater, air pre-heater discharge gas duct, and so on forth are carried in and installed, thereby completing installation of the boiler facilities.

As shown in FIGS. 2, 4, 6, 8, and 10, As the suspending weight of the boiler main unit 35 progresses, the weight thereof gradually increases, but the second-level through fourth-level steel columns 24, 27, and 30, and third through eighth floor units 52, 53, 58, 59, 61, and 62 are added, providing mechanical reinforcement to the structure.

While the mill 8 and bunker 9 and the like are exemplarily described as being installed to the front of the boiler building 34 in the above embodiment, these may be disposed to the sides of the boiler building 34.

What is claimed is:

1. An installation construction method for boiler facilities in which said boiler facilities comprise:

a boiler building configured of a steel structure, and a boiler main unit suspended within the boiler building from top girders disposed above the boiler building, wherein: the steel structure is provided with center steel columns at the width-wise center portion of the boiler building and end steel columns at the width-wise end portions of the boiler building, the central steel columns and end steel columns being symmetric with respect to a vertical axis, the end steel columns located furthest away from the vertical axis;

the boiler main unit is divided into an upper portion, a middle portion and a lower portion;

the center steel columns of the boiler building are erected and the top girders are disposed above the center steel columns wherein a first level of the end steel columns are erected;

the upper portion of the boiler main unit is suspended from the top girders while a next level of end steel columns are added adjacent a next level of center steel columns, providing mechanical reinforcement to the width-wise end portions thereof, the middle portion of the boiler main unit is suspended from the top girders while the another level of end steel columns are further added adjacent another level of center steel columns, providing mechanical reinforcement to the width-wise end portions thereof; and the lower portion of the boiler main unit is suspended from the top girders while the remaining end steel columns are further added adjacent a remaining level of center steel columns, providing mechanical reinforcement to the width-wise end portions thereof, thereby completing the boiler building wherein a height of each level of end steel columns and center steel columns is substantially equal, and the construction symmetrical about the vertical axis.

2. The installation construction method for boiler facilities according to claim 1, wherein, while adding the remaining end steel columns of the boiler building, various types of equipment to be provided to the boiler main unit and accessory members accessory thereto are carried into and installed in the boiler building under construction.

3. The installation construction method for boiler facilities according to claim 1, wherein the center steel columns are and the end steel divided into multiple stages in a vertical direction of the boiler building; and when the center steel columns of the boiler building are erected, respective floor units are installed between the lowest first-level column of the center steel columns through second and following level steel columns erected above the first-level column.

4. The installation construction method for boiler facilities according to claim 1, wherein the center steel columns are and the end steel columns divided into multiple stages in a vertical direction of the boiler building; and when the center steel columns of the boiler building are erected, the lowest first-level steel columns are erected substantially over the entire width-wise area of the boiler building and respective floor units are installed between the first steel columns respectively.

5. The installation construction method for boiler facilities according to claim 4, wherein as the upper, middle and lower portions of the boiler main unit are suspended, the second-level through following level and steel columns to be erected above the first-level end steel columns of the end steel columns of the boiler building are added and floor units are added between the second-level through following level steel columns.

6. The installation construction method for boiler facilities according to claim 3, wherein the center steel columns and the end steel columns are divided into multiple stages in a vertical direction of the boiler building; and when the steel columns are erected at the width-wise center portion of the boiler building, the lowest first-level steel columns are erected over the entire width-wise area of the boiler building and respective floor units are installed between the first steel columns respectively.

* * * * *